US005189470A

United States Patent [19]

Matsuda et al.

[11] Patent Number: 5,189,470

[45] Date of Patent: Feb. 23, 1993

[54] XEROGRAPHIC APPARATUS FOR LABEL PRINTER

[75] Inventors: Yasuhiko Matsuda; Kazuhiro Karuishi; both of Iwate, Japan

[73] Assignee: Kabushiki Kaisha Sato, Japan

[21] Appl. No.: 771,126

[22] Filed: Oct. 1, 1991

[30] Foreign Application Priority Data

| | | | |
|---|---|---|---|
| Oct. 3, 1990 | [JP] | Japan | 2-103664[U] |
| Oct. 3, 1990 | [JP] | Japan | 2-263908 |
| Oct. 3, 1990 | [JP] | Japan | 2-263909 |
| Oct. 3, 1990 | [JP] | Japan | 2-263910 |
| Oct. 3, 1990 | [JP] | Japan | 2-263911 |
| Oct. 12, 1990 | [JP] | Japan | 2-274426 |
| Oct. 12, 1990 | [JP] | Japan | 2-274427 |
| Oct. 12, 1990 | [JP] | Japan | 2-274428 |
| Oct. 31, 1990 | [JP] | Japan | 2-294514 |
| Nov. 30, 1990 | [JP] | Japan | 2-128789[U] |

[51] Int. Cl.[5] ..... G03G 15/00

[52] U.S. Cl. ..... 355/208; 355/309; 346/136

[58] Field of Search ..... 355/208, 309, 311, 290, 355/282, 202; 226/24, 42, 44; 346/136; 340/675; 250/559

[56] References Cited

U.S. PATENT DOCUMENTS

| | | | |
|---|---|---|---|
| 4,213,551 | 7/1980 | Windele | 355/309 |
| 4,513,898 | 4/1985 | Spitsbergen | 226/44 |
| 5,041,850 | 8/1991 | Kahoyashi et al. | 355/202 X |

*Primary Examiner*—Joan H. Pendegrass

*Attorney, Agent, or Firm*—Ostrolenk, Faber, Gerb & Soffen

[57] ABSTRACT

A xerographic apparatus for a label printer which receives a continuous label strip on which printing occurs. The apparatus has a photosensitive drum, a toner fixing section including rollers, a label strip conveyor located between the photosensitive drum and the toner fixing section, a detector for detecting slack in the continuous label strip positioned between the label strip conveyor and the toner fixing section, and a controller responsive to the output of the detector for controlling the speed or the clamping force of the toner fixing section rollers in order to increase the conveyance speed of the continuous label strip at the toner fixing section when the slack detector detects the presence of slack.

8 Claims, 17 Drawing Sheets

XEROGRAPHIC APPARATUS FOR LABEL PRINTER

BACKGROUND OF THE INVENTION

1. Field of the Invention

This invention relates to a xerographic apparatus for a label printer, more particularly to such an apparatus which uses a continuous label strip comprising a backing sheet having a series of labels provisionally attached thereto, and still more particularly to such an apparatus which eliminates any slack arising in the continuous label strip ahead of the toner fixing section.

2. Description of the Prior Art

For labeling purposes there is commonly used a continuous label strip fabricated by trimming labels obtained from a label sheet into an appropriate shape and then provisionally attaching them serially at appropriate intervals to the side of a backing strip which has been coated with a release agent. While the printing of the required information onto the labels has most often been conducted by use of a thermal printer, xerographic printing apparatus have also recently come into use.

Although the individual labels are separated from each other by creases, they are in some cases provisionally attached to the backing strip without any interval therebetween, whereas in other cases labels trimmed from label sheets and removed of the trimmed scraps are provisionally attached at prescribed intervals. This latter type of continuous label strip is widely used because of such various advantages such as that the labels can be freely designed to have rounded corners or to be circular, triangular, hexagonal, flower shaped or the like, that the label strip has regions with different transmittance which can be used for detecting the label pitch (the interval at which the labels are provisionally attached to the backing strip) without need for affixing any other special mark or the like, and that the labels are easy to detach from the backing strip.

Referring to FIG. 1, in a continuous label strip A consisting of labels L cut from a label sheet attached at prescribed intervals to a backing strip S, the regions D of the backing strip S not overlaid with labels L are generally exposed in their state as coated with a silicon-based release agent. The thickness of the continuous label strip A is thus different between these regions D and the regions where the labels L are overlaid on the backing strip S.

Where a xerographic apparatus is used, the peripheral speed of its photosensitive drum and that of the toner fixing section are precisely the same and become the conveyance speed of the continuous label strip A.

When label printing is conducted with a continuous label strip A of the foregoing type loaded in the conventional xerographic apparatus, slippage occurs between the rollers at the toner fixing section and the continuous label strip A passing therethrough because of the lower coefficient of friction of the regions D coated with the exposed release agent and at the transition regions between the regions where the labels L are overlaid on the backing strip S and the regions D consisting solely of the backing strip S, which leads to slippage in the conveyance of the continuous label strip A at the toner fixing section.

As a result, the conveyance rate of the continuous label strip becomes lower at the toner fixing section than at the photosensitive drum, which causes the portion of the continuous label strip ahead of the toner fixing section to be come slack. In the case of continuous printing or the like, the amount of this slack progressively accrues and becomes a cause for jamming.

OBJECT AND SUMMARY OF THE INVENTION

In view of the aforesaid shortcoming of the conventional apparatus, an object of this invention is to provide a xerographic apparatus for a label printer which detects and eliminates any slack occurring in the continuous label strip ahead of the toner fixing section.

In accordance with a first aspect of the invention, this object is achieved by providing a xerographic apparatus for a label printer comprising an independent motor for driving the toner fixing section, means for detecting slack in the continuous label strip between the continuous label strip conveyance means on the photosensitive drum side and the toner fixing section, and means responsive to the output of the detection means for controlling the speed of the toner fixing section drive motor in order to increase the amount of conveyance of the continuous label strip per unit time at the toner fixing section as required for eliminating the slack.

In accordance with a second aspect of the invention, this object is achieved by providing a xerographic apparatus for a label printer comprising means for applying clamping force to the continuous label strip for conveyance thereof at the toner fixing section, means for detecting slack in the continuous label strip between the continuous label strip conveyance means on the photosensitive drum side and the toner fixing section, and means responsive to the output of the detection means for increasing the clamping force of the clamping force means in order to increase the amount of conveyance of the continuous label strip per unit time as required for eliminating the slack.

BRIEF DESCRIPTION OF THE DRAWINGS

The invention will be described in greater detail in the following detailed description with reference to the drawings in which.

DETAILED DESCRIPTION OF THE PREFERRED EMBODIMENTS

Figure 1:
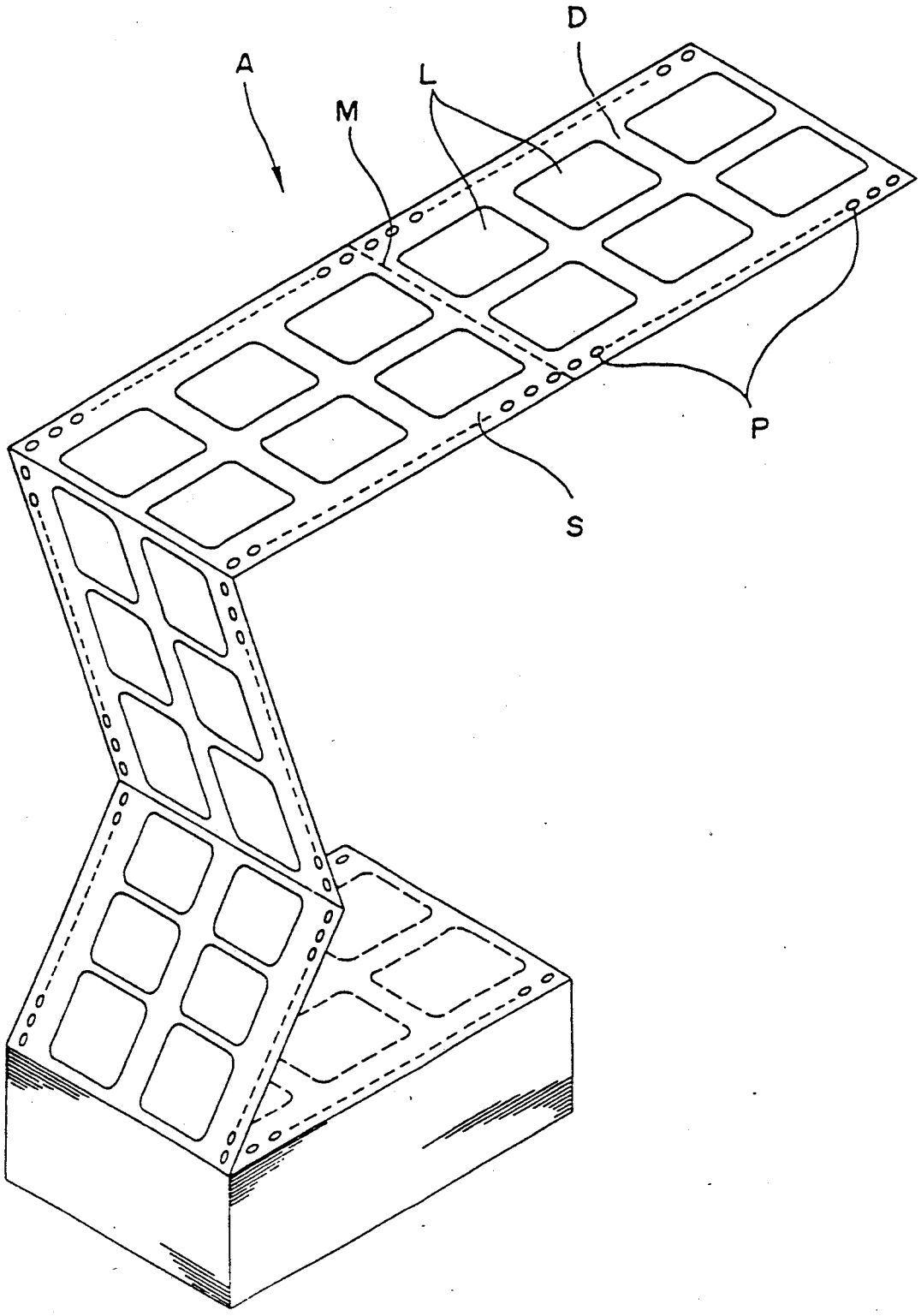
FIG. 1 is a perspective view of a fanfold type continuous label strip.

The fanfold continuous label strip A shown in FIG. 1 has sprocket holes P along both edges of its backing strip S and is folded at perforations M provided to make it easily separable into sections of unit size. The fanfold strip is convenient for use in continuously printing different types of data since the portions printed with the required data can thereafter be easily detached and the printing apparatus need not be provided with a wind-up mechanism as required in the case of using a roll strip.

Figure 2:
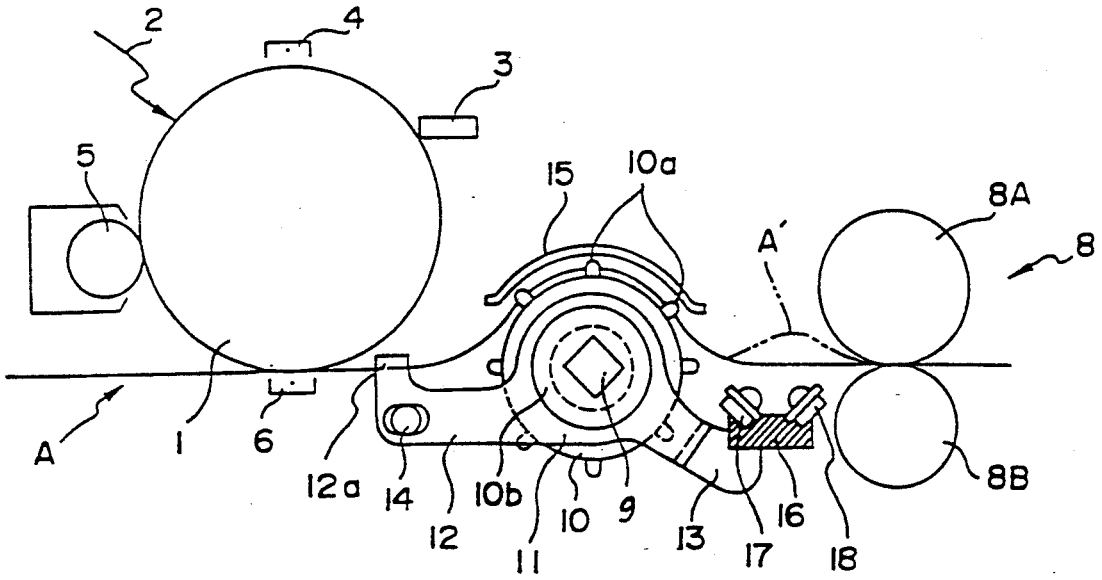
FIG. 2 is a schematic side view of a xerographic apparatus.

FIG. 2 shows a xerographic apparatus for a label printer that uses a continuous label strip of the fanfold type. In this figure, reference numeral 1 designates a photosensitive drum, 2 a light beam emitted by a semiconductor laser, an LED array or other such means capable of emitting a light beam in accordance with image data received from an electrostatic latent image forming means, 3 a cleaning brush, 4 a photosensitizing charger, 5 a developer and 6 an image transfer charger. Reference numeral 8 indicates a toner fixing section comprising a heat roller 8A and a auxiliary roller 8B. Reference numeral 10 designates one of a pair of sprockets (only one shown) positioned between the photosensitive drum 1 and the toner fixing section 8 and provided on its periphery with regularly spaced pins 10*a* for engagement with the sprocket holes P of the continuous label strip A. The two sprockets 10 are provided on opposite sides of the continuous label strip A and are arranged in a known manner to be symmetrically movable with respect to the center of the continuous label strip A for setting at positions suitable for the width of the continuous label strip A in use. Reference numeral 11 designates one of a pair of paper guide members clamped between a boss of the sprocket 10 and a flange 10*b* and engaged with a pin 14 so as to be movable together with the sprocket 10 in the width direction of the continuous label strip A but to be restrained against rotation. An arm 12 of the paper guide member 11 extending in the direction of the photosensitive drum 1 constitutes a paper guide 12*a*. While the pins 10*a* of the sprocket 10 provide a degree of guidance for the continuous label strip A, the paper guides 12*a* operate in cooperation with the pins 10*a* to extend the range of this guidance. Reference numeral 15 designates one of a pair of paper bails 15 of well-known design, which are movable together with the sprockets 10 in the width direction of the continuous label strip A and are, for instance, screw-attached to the paper guide member 11 so as to be swingable between a first open position in which the continuous label strip A is free from restraint thereby and a second closed position in which it is restrained thereby. Reference numeral 16 designates a holder mounted on an arm 13 formed as extension of one of the paper guide members 11 in the direction of the toner fixing section 8. The holder 16 supports a light emitting element 17 and a light receiving element 18 positioned to enable monitoring of the amount of light reflected from an edge portion of the continuous label strip A (an edge portion not affected by the sprocket holes P). The position of the light emitting element 17 and light receiving element 18 varies with the position of the paper guide member 11 so that it is automatically adjusted as appropriate for the particular type of continuous label strip A in use.

The photosensitive drum 1 and the sprocket 10 are driven by a common power source (motor) through a common drive mechanism (neither shown) so as to rotate at the same peripheral speed.

Figure 3:
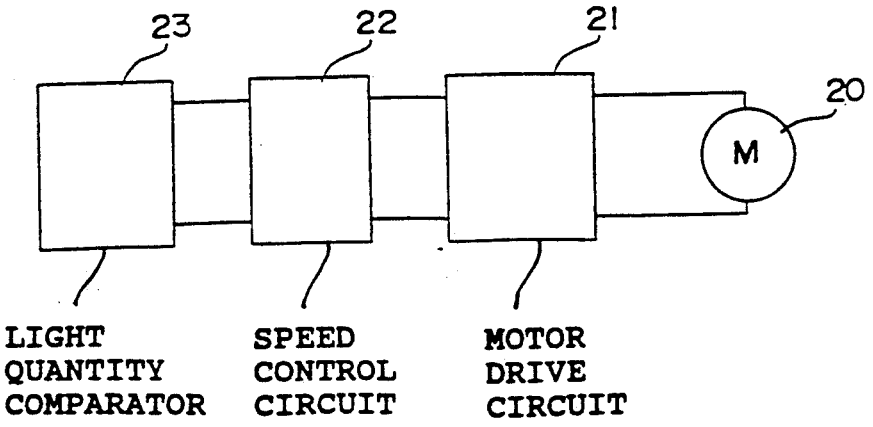
FIG. 3 is a block diagram of a controller for controlling a toner fixing section speed control motor.

The toner fixing section 8 is driven independently of the photosensitive drum system by a toner fixing section speed control motor 20 which, as shown in FIG. 3, is controlled by a controller consisting of a motor drive circuit 21, a speed control circuit 22 and a light quantity comparator 23.

The light quantity comparator 23 outputs a speed switchover command signal to the speed control circuit 22 in accordance with whether the output of the light receiving element 18 based on the amount of light reflected by the continuous label strip A is higher or lower than a reference level (which is preferably a reference range of predetermined breadth), whereby the peripheral speed of the toner fixing section 8 is switched between one equal to, and one faster than, that of the photosensitive drum 1.

In the foregoing arrangement, the electrostatic latent image forming means for emitting the beam 2, the photosensitive drum 1 and the other operating mechanisms are controlled by a controller (not shown) for the apparatus as a whole so as to print image information onto the labels L of the continuous label strip A.

As seen in FIG. 2, the continuous label strip A is conveyed in from the left, toner images are transferred to the labels L from the photosensitive drum 1 at the image transfer charger 6, the continuous label strip A is conveyed to the toner fixing section 8 where the toner images are fixed on the labels, and the continuous label strip A with the printed labels is discharged to the right.

Since as shown in FIG. 1 the continuous label strip A has the labels L fixed on its backing strip S at prescribed intervals, discrete regions D consisting solely of the backing strip S are present from place to place. These regions D consisting solely of the backing strip S are exposed release agent-coated surfaces with a low coefficient of friction and, moreover, the thickness of the continuous label strip A is different between the regions D and the regions overlaid with the labels L. As a result, when the continuous label strip A passes through the toner fixing section 8, the heat roller 8A tends to bounce with respect to the auxiliary roller 8B and this, in conjunction with the lower coefficient of friction at the regions D, cause slipping between the toner fixing section 8 and the continuous label strip A.

The continuous label strip A therefore tends to become slack ahead of the toner fixing section 8, as shown by the two-dot-chain line in FIG. 2. This slack reduces the proportion of the light emitted by the light emitting element 17 that is reflected from the continuous label strip A so that the output of the light receiving element 18 decreases. When this output falls below the reference level set in the light quantity comparator 23, the light quantity comparator 23 issues a speed switchover command signal to the speed control circuit 22.

As a result, the speed of the toner fixing section speed control motor 20 is increased for raising the peripheral speed of the toner fixing section 8 above that of the photosensitive drum 1 and the sprocket 10. As this increases the amount of conveyance of the continuous label strip per unit time, the slack is taken up.

Once the slack has been removed from the continuous label strip A, the output of the light receiving element 18 again rises above the reference level and, accordingly, the peripheral speed of the toner fixing section 8 is returned to that of the photosensitive drum 1 and the sprocket 10.

In the embodiment of the invention just explained, slack is removed from the continuous label strip A by controlling the speed of the rollers at the toner fixing section 8. Another embodiment will now be described in which slack in the continuous label strip A is taken up by controlling the clamping force applied for conveying the continuous label strip A at the toner fixing section 8.

In this embodiment, the toner fixing section 8 is driven by a separate power source from that used to drive the photosensitive drum 1 and the speed of the toner fixing section rollers is set to be higher than that of the photosensitive drum 1. The rate of conveyance of the continuous label strip A is varied by raising and lowering the contact pressure between the heat roller 8A and the auxiliary roller 8B.

Figure 4:
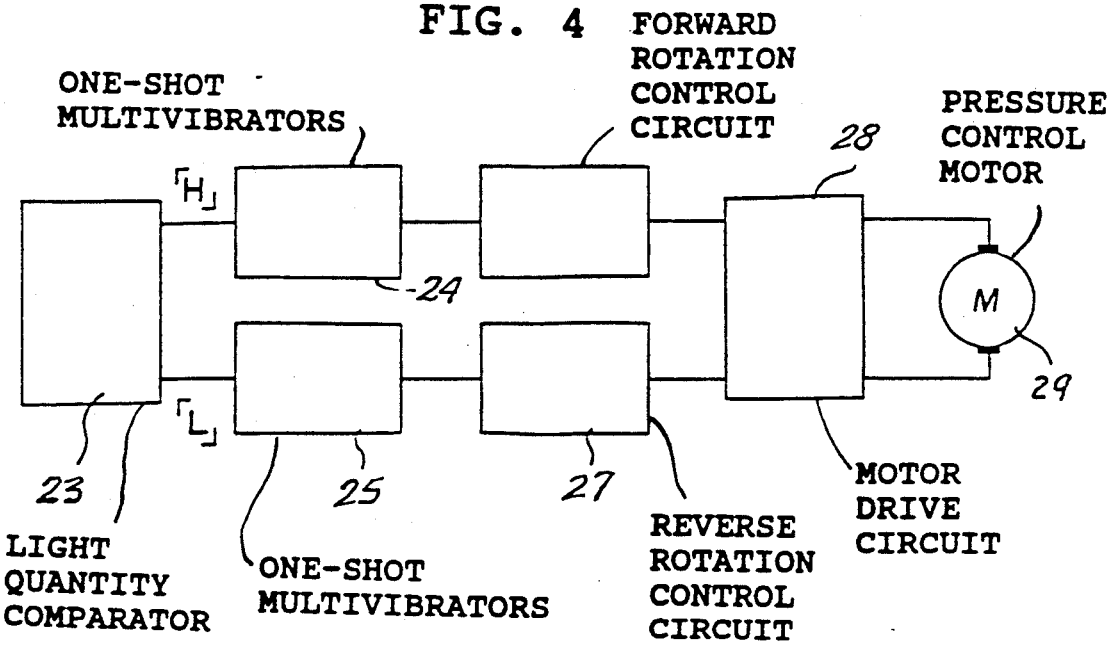
FIG. 4 is a block diagram of a controller for switching over the contact pressure applied by a toner fixing section pressure control motor.

As shown in FIG. 4, the light quantity comparator 23 outputs a pressure switchover command signal for controlling the contact pressure of the toner fixing section 8 in accordance with whether the output of the light receiving element 18 based on the amount of light reflected by the continuous label strip A is higher or lower than the reference level. Specifically, when the aforesaid output is lower than the reference level, the light quantity comparator 23 outputs a command signal "H" for increasing the contact pressure between the heat roller 8A and the auxiliary roller 8B. The command signal "H" is forwarded to a one-shot multivibrator 24 and then through a forward rotation control circuit 26 and a motor drive circuit 28 for rotating a pressure control motor 29 of the toner fixing section in the forward direction for a prescribed period of time. When the signal received from the light receiving element 18 again rises above the reference level, the light quantity comparator 23 outputs a command signal "L" for decreasing the contact pressure between the heat roller 8A and the auxiliary roller 8B. The command signal "L" is forwarded to a one-shot multivibrator 25 and then through a reverse rotation control circuit 27 and the motor drive circuit 28 for rotating the pressure control motor 29 in the reverse direction for a prescribed period of time.

Figure 5:
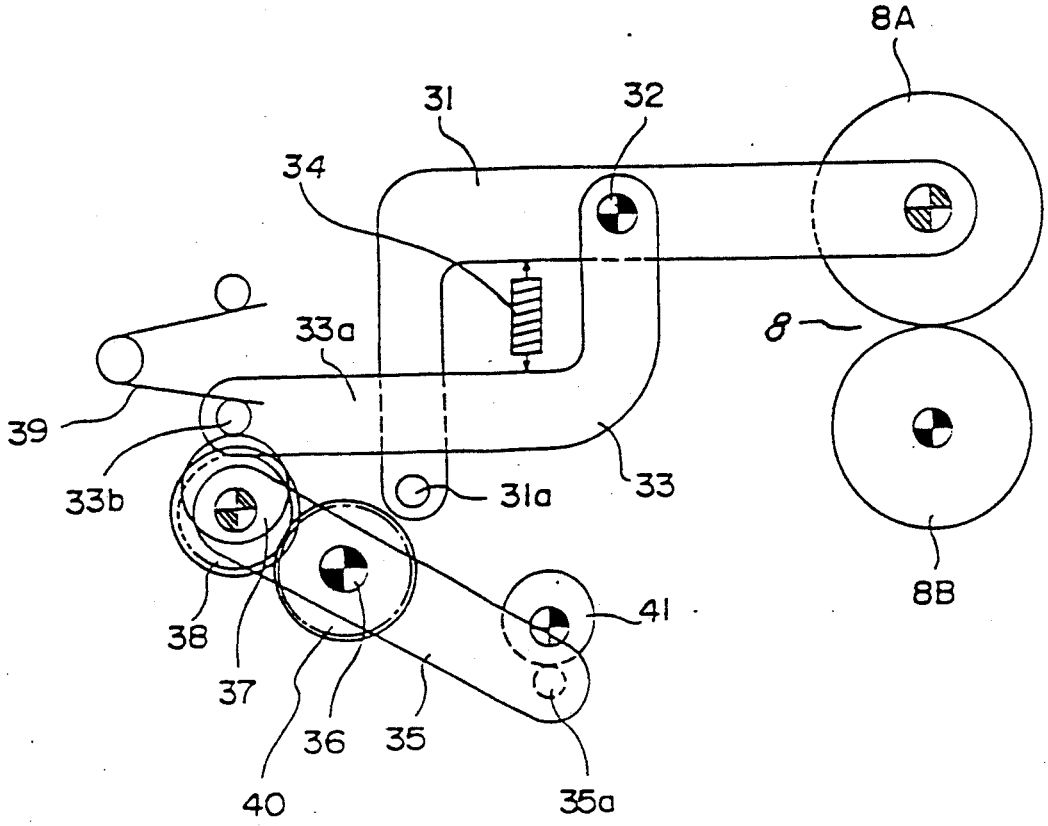
FIG. 5 is a side view of a toner fixing section pressure control mechanism.

The pressure control mechanism of the toner fixing section 8 is shown in FIG. 5. The heat roller 8A of the toner fixing section 8 is rotatably fixed on one end of a roller support lever 31 pivotally supported by a shaft 32 and having a pin **31*a* projecting from the other end thereof. A roller operating lever 33 pivoted at one end on the shaft 32 has an arm 33*a* which extends to a position opposed to the pin 31*a* and has a pin 33*b* projecting from near the tip thereof. A spring 34 connected between the roller support lever 31 and the roller operating lever 33 acts mainly to urge the roller support lever 31 clockwise and thus apply pressure to the heat roller 8A. A cam 37 and a gear 38 formed integrally therewith are rotatably attached to one end of a pressure regulation lever 35 pivotally supported on a shaft 36 and having a pin 35*a* projecting from the other end thereof. The cam 37 slidably contacts the pin 33*b* of the roller operating lever 33. A spring 39 urges the roller operating lever 33 counterclockwise for applying a force tending to separate the heat roller 8A and the auxiliary roller 8B. A gear 40 fixed on the shaft of a motor (not shown) for controlling the engagement between the heat roller 8A and the auxiliary roller 8B is disposed to mesh with the gear 38. A cam 41 fixed on the shaft of the motor 29 (FIG. 4) makes sliding contact with the pin 35*a* of the pressure regulation lever 35**.

Similarly to what was explained earlier, when slack occurs in the continuous label strip A, the output of the light receiving element 18 drops because the continuous label strip A reflects less of the light from the light emitting element 17 toward the light receiving element 18, and when the level of this output falls below the reference level, the light quantity comparator 23 outputs the pressure switchover command signal "H", thus activating the one-shot multivibrator 24 and, via the forward rotation control circuit 26 and the motor drive circuit 28, causing the toner fixing section pressure control motor 29 to rotate in the forward direction for a prescribed period of time. As a result, the cam 41, initially in contact with the pin **35*a* at a low height portion thereof, is rotated to a position in which the high height portion thereof comes in contact with the pin 35*a*. This causes the pressure regulation lever 35 to rotate clockwise, whereby the cam 37 moves upward as the gear 38 rolls along the gear 40. The cam 37 thus pushes the pin 33*b* upward, causing the roller operating lever 33 to rotate clockwise against the force of the spring 34. As a result, the force stored by the spring 34 disposed between the roller operating lever 33 and the roller support lever 31 is increased to thereby increase the pressure with which the heat roller 8A contacts the auxiliary roller 8B**.

Since the peripheral speed of the toner fixing section rollers is set to be faster than that the photosensitive drum 1 (and the sprocket 10), the stronger contact pressure between the heat roller 8A and the auxiliary roller 8B resulting from the foregoing operation increases the rate at which the continuous label strip A is conveyed at the toner fixing section 8, whereby the slack in the continuous label strip A is taken up.

Once the slack has been removed from the continuous label strip A, the output of the light receiving element 18 again rises above the reference level so that the light quantity comparator 23 outputs a command signal "L" to activate the one-shot multivibrator 25, whereby the one-shot multivibrator 25 and the reverse rotation control circuit 27 operate to rotate the pressure control motor 29 in the reverse direction for a prescribed period of time. This causes the cam 41 to rotate to make contact with the pin 35*a* at its low height portion instead of its high height portion. Therefore, the pressure regulation lever 35 rotates counterclockwise under the force of the spring 39 as the pin 35*a* of the pressure regulation lever 35 follows the cam 41. As a result, the amount of force stored by the spring 34 decreases so that the heat roller 8A applies less pressure to the auxiliary roller 8B and this in turn readjusts the conveyance rate of the continuous label strip A at the toner fixing section 8 to that at the photosensitive drum 1.

In either of the two embodiments described above, undesirable hunting may occur if the width of the reference level (range) is set too narrowly. This problem can be overcome by appropriately broadening the reference range or by providing the circuit with a timer function for canceling reverse rotation operations of less than a prescribed time length.

When toner fixing is not being conducted in the toner fixing section 8, the heat roller 8A is separated from the auxiliary roller 8B by operating a motor (not shown) to rotate the gear 40 by a prescribed amount. This rotation of the gear 40 is transmitted to the gear 38 to cause the low height portion of the cam 37 integral therewith to contact the pin 33*b*. As a result, the roller operating lever 33 rotates counterclockwise as the pin 33*b* follows the cam 37. In the course of the rotation of the roller operating lever 33, its arm 33*a* strikes against the pin 31*a* and from this point on the roller support lever 31 is also rotated counterclockwise. The heat roller 8A therefore separates from the auxiliary roller 8B.

In the arrangement shown in FIG. 5, the cam 37 (motor) for engaging and disengaging the heat roller 8A and the auxiliary roller 8B and the cam 41 (motor 29) for regulating the pressure of the heat roller 8A against the auxiliary roller 8B are provided as independent components. Alternately, however, it is possible to use an arrangement wherein both of these operations are conducted using a single cam.

In the arrangement shown in FIG. 4, one-shot multivibrators 24 and 25 are used for setting the time period during which the pressure control motor 29 is rotated and the actual amount of rotation of the cam 41 is regulated by open loop control.

Figure 6:
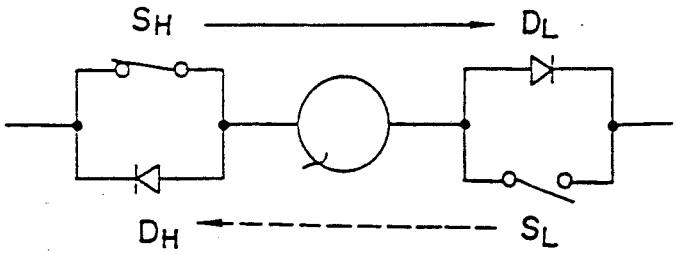
FIG. 6 is a diagram showing a motor stopping circuit.

It is alternatively possible to regulate the amount of cam 41 rotation by closed loop control without using a multivibrator. As shown in FIG. 6, this can be accomplished, for example, by connecting a parallel circuit consisting of a limit switch SH and a diode DH to one terminal of the motor 29 and a parallel circuit consisting of a limit switch SL and a diode DL to the other terminal thereof.

The arrangement is such that when the pin 35*a* is in contact with the low height portion of the cam 41, the limit switch SL is open and the limit switch SH is closed. If a forward rotation signal is produced at this time, current will pass through the limit switch SH, the motor 29 and the diode DL as indicated by solid arrow in FIG. 6 and the motor 29 will rotate in the forward direction to cause the cam 41 to rotate from the position at which the pin 35*a* contacts its low height portion to the position at which the pin 35*a* contacts its high height portion, thus closing the limit switch SL and opening the limit switch SH. The motor 29 therefore stops.

The closing of the limit switch SL establishes a reverse rotation signal standby state. When a reverse rotation signal is produced, current will thus pass through the limit switch SL, the motor 29 and the diode DH as indicated by the broken line arrow and the motor 29 will rotate in the reverse direction to cause the cam 41 to rotate and close the limit switch SH again while, at the same time, causing the limit switch SL to open when the low height portion of the cam comes into contact with the pin 35*a*. The motor 29 therefore stops.

While the paper guide member 11 provided in conjunction with the sprocket 10 in the two embodiments described above is extended up to the downstream side of the photosensitive drum 1, it is alternatively possible to extend it as far as the upstream side of the drum.

Moreover, the reflection type slack detection means can be replaced with transmission type detection means.

In addition, instead of using only a single light receiving element it is possible to use a multistage line sensor or a multistage level sensor and to subdivide the peripheral rotation control range or the contact pressure control range into a number of stages.

Further, in place of the continuous label strip conveyance means using the sprocket 10, there can be used a pin-tractor conveyance system in which the continuous label strip is laid on the flat upper section of an endless belt supported by two laterally spaced pulleys and conveyed together with the belt by engagement of pins formed on the belt with the sprocket holes of the label strip.

While it is possible to use either a sprocket type conveyance system or a pin-tractor conveyance system in which a flat conveyance path of prescribed length is formed by supporting an endless belt with pins on two laterally separated pulleys, the sprocket system proves to be advantageous, as will be understood from the following comparison.

Since the pin-tractor system increases the time required for the information transferred to the continuous label strip A (the labels L) to be output from the toner fixing section 8 in printed form, it thus prolongs the period between data input and the time that the output information can be visually checked. Moreover, the section of the continuous label strip A which remains between the toner fixing section 8 and the photosensitive drum 1 after all of the printed labels have been output and which is impossible to use for printing becomes longer, thus increasing the amount of the label strip that goes to waste. Another disadvantage is that the xerographic apparatus becomes longer in the direction of label strip conveyance.

When the sprocket system is used, the short length of the xerographic apparatus in the direction of label strip conveyance advantageously makes it possible to dispose the photosensitive drum 1 and the toner fixing section 8 closer to each other, thus mitigating the aforesaid disadvantages of the pin-tractor system. Furthermore, the sprocket system can be used in conjunction with a paper guide member for preventing snaking of the continuous label strip A.

Moreover, as the continuous label strip it is possible to use roll label strip in place of the fanfold label strip. Roll label strip is particularly advantageous for use in cases where the same date is to be repeatedly printed continuously and in large volume. In an apparatus which uses roll label strip without sprocket holes, a roller drive system is used in place of the sprocket or pin-tractor system. It is also preferable to provide the apparatus with a mechanism for winding up the label strip after printing.

In a xerographic apparatus for label printing that uses a continuous label strip fabricated by provisionally attaching labels cut from a label sheet to a backing strip, the foregoing embodiments provide improved apparatus which prevent jamming by monitoring the continuous label strip for occurrence of slack owing to slipping at the toner fixing section and immediately eliminating any slack that arises and which further enable printing of labels as desired without undue waste of the label strip. As such, they are extremely practical.

Figure 7:
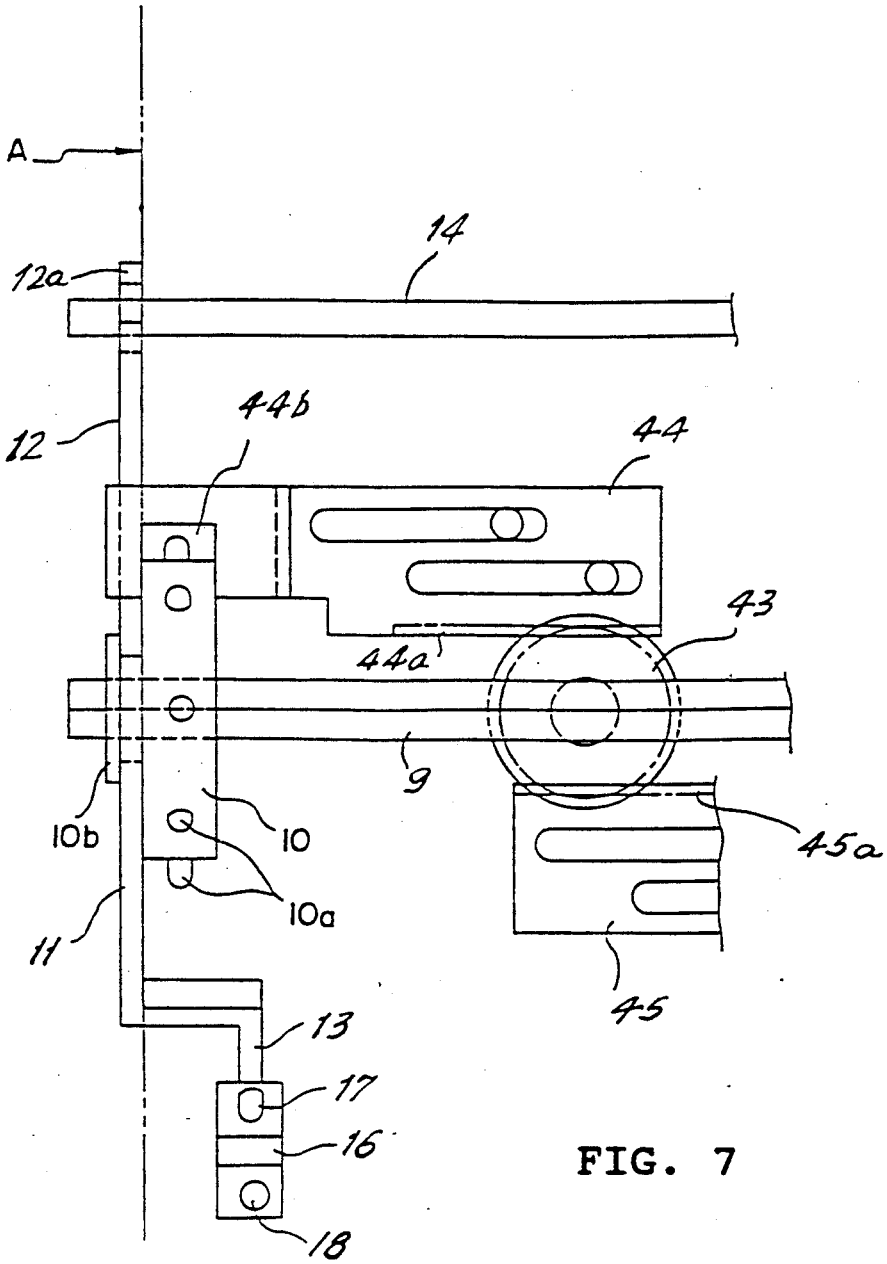
FIG. 7 is a diagram showing a mechanism for setting the positions of sprockets and detection elements in accordance with the width of the continuous label strip.

As mentioned earlier, the light emitting element 17 and the light receiving element 18 supported on the arm 13 of the paper guide member 11 by the holder 16 have to be appropriately positioned with respect to the width of the continuous label strip A. A mechanism for this purpose is shown in FIG. 7.

The sprockets 10 are fixed on a drive shaft 9 so as to rotate integrally therewith but to be slidable in the axial direction of the drive shaft 9.

Beneath the drive shaft 9 is a gear 43 that is only capable of rotating and a pair of strip width setting plates 44 and 45 formed with racks 44*a* and 44*b* that are engaged with the gear 43. An upright portion of the strip width setting plate 44 at the end thereof nearer the sprocket 10 is formed with a bifurcated member 44*b* into which the sprocket 10 is rotatably fit. The strip width setting plate 45 is similarly configured.

Thus the sprockets 10 can be symmetrically moved in the width direction of the label strip by the linkage mechanism constituted by the strip width setting plate 44, the gear 43 and the strip width setting plate 45. Since the positions of the light emitting element 17 and the light receiving element 18 have a fixed relationship to the position of the paper guide member 11, they are automatically positioned properly with respect to the width of the continuous label strip A.

When the continuous label strip A is replaced with one of a different width, the sprockets 10 are repositioned as appropriate for the new strip width by means of the mechanism shown in FIG. 7. As this operation also moves the paper guide member 11, the light emitting element 17 and the light receiving element 18 mounted on the holder 16 are positioned so as to be able project light onto and monitor the light reflected from the edge of the continuous label strip A. The light emitting element 17 and the light receiving element 18 are thus automatically able to carry out the detection function required for eliminating slack from the continuous label strip A.

For ensuring that the sprockets 10 will not be displaced by vibration or the like after once being properly positioned, the strip width setting plates 44, 45 and/or the gear 43 are arranged so that they can be provisionally locked in place.

As was mentioned earlier, in place of the sprocket type conveyance system it is possible to use a pin-tractor conveyance system in which the continuous label strip is laid on the flat upper section of an endless belt supported by two laterally spaced pulleys and conveyed together with the belt by engagement of pins formed on the belt with the sprocket holes of the label strip. When this pin-tractor system is used, the detector elements are mounted as restrained from rotation on a member which moves in the width direction of the continuous label strip in response to the width setting operation.

In view of the fact that when a continuous label strip A comprising a backing strip S having trimmed labels L provisionally attached thereto at prescribed intervals (D) is used in a xerographic apparatus, the continuous label strip A is apt to develop slack just ahead of the toner fixing section 8, it is important to minimize the likelihood of such slack occurring.

One way of doing this is to install a means for conveying the already printed continuous label strip A at a position beyond the toner fixing section 8 as seen from the side of the photosensitive drum 1 and to set the speed at which this label strip conveyance means conveys the continuous label strip A to be higher than the conveyance speed at the toner fixing section 8.

Figure 8:
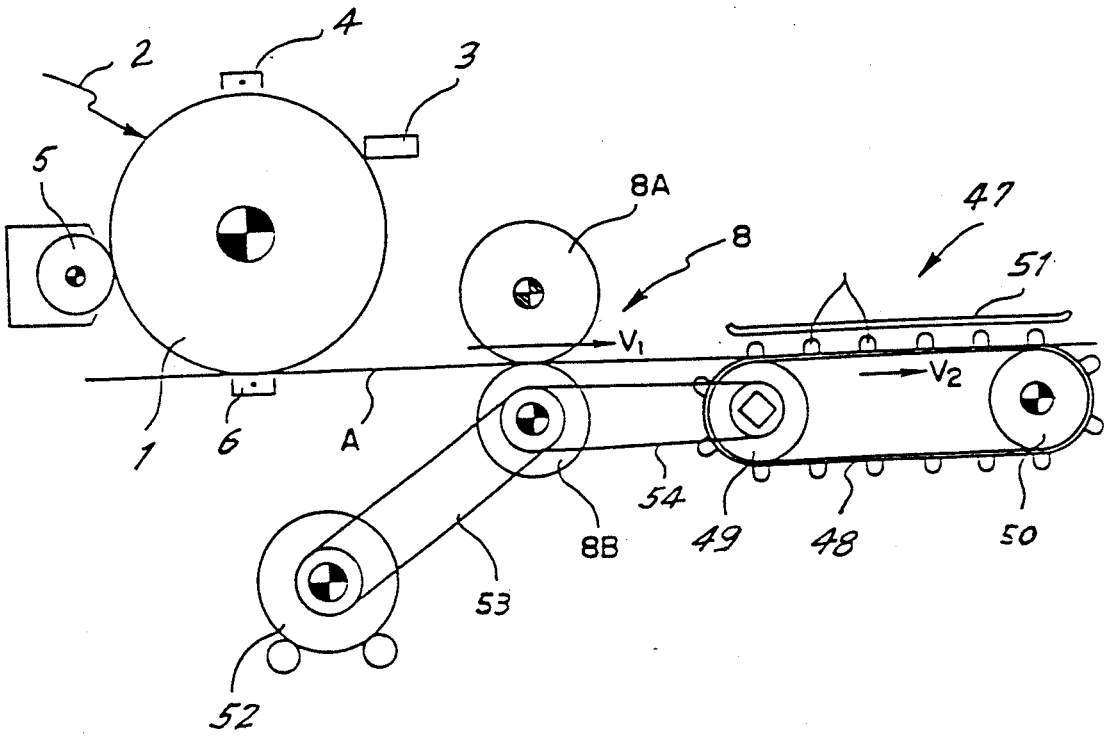
FIGS. 8 and 9 are explanatory views showing a continuous label strip conveyance means installed downstream of the toner fixing section.

An embodiment employing this concept is shown in FIG. 8.

The apparatus according to this embodiment has a label strip conveyance means 47 of the pin-tractor type installed downstream of the toner fixing section 8. The conveyance means 47 is of the ordinary type comprising an endless belt 48 having regularly spaced pins 48*a* for engagement with the sprocket holes P of the continuous label strip A, pulleys 49 and 50, and a paper presser foot 51.

The rotation of a drive motor 52 for the toner fixing section is transmitted through a timing belt 53 to the auxiliary roller 8B which is in turn coupled with the label strip conveyance means 47 via a timing belt 54. Defining the peripheral speed V1 of the rollers of the toner fixing section as 100, the speed V2 of the endless toner fixing section as 100, the speed V2 of the endless belt 48, i.e. the peripheral speed of the pulley 49, is set at between 101 and 103. This stepping up of the peripheral speed can be achieved by, for example, appropriately selecting the diameter ratio between the two pulleys connected by the timing belt 54.

Since in this embodiment the speed V2 at which the label strip conveyance means 47 installed downstream of the toner fixing section 8 conveys the continuous label strip A is set between 101 and 103 based on the conveyance speed V1 of the rollers of the toner fixing section 8 as 100, there arises a traction effect which prevents the occurrence of the aforesaid slipping. As a result, the development of slack in the continuous label strip A ahead of the toner fixing section 8 is suppressed.

The upper limit of the label strip conveyance speed V2 at the label strip conveyance means 47 is set at 103 with respect to the conveyance speed Vl at the toner fixing section 8 as 100 based on tests showing that speeds higher than 103 tend to cause the continuous label strip A to sever at the perforations M because of the excessively large traction force that develops in the label strip.

The primary cause for the development of slack in the continuous label strip A is the slipping that occurs between the continuous label strip A and the toner fixing section rollers at the regions D of the continuous label strip A, i.e. at the regions consisting solely of the backing strip S. Considering this fact in conjunction with the fact that the regions D are regions that are not printed, it was concluded that the cause for the occurrence of slack in the continuous label strip A could be eliminated by (a) installing a means for conveying the already printed continuous label strip A at a position beyond the toner fixing section 8 as seen from the photosensitive drum 1 or (b) arranging the label strip conveyance means so that the conveyance of the continuous label strip A during those times when a region D located between adjacent labels L is passing through the toner fixing section 8 is conducted at a lower contact pressure between the heat roller 8A and the auxiliary roller 8B.

Figure 9:
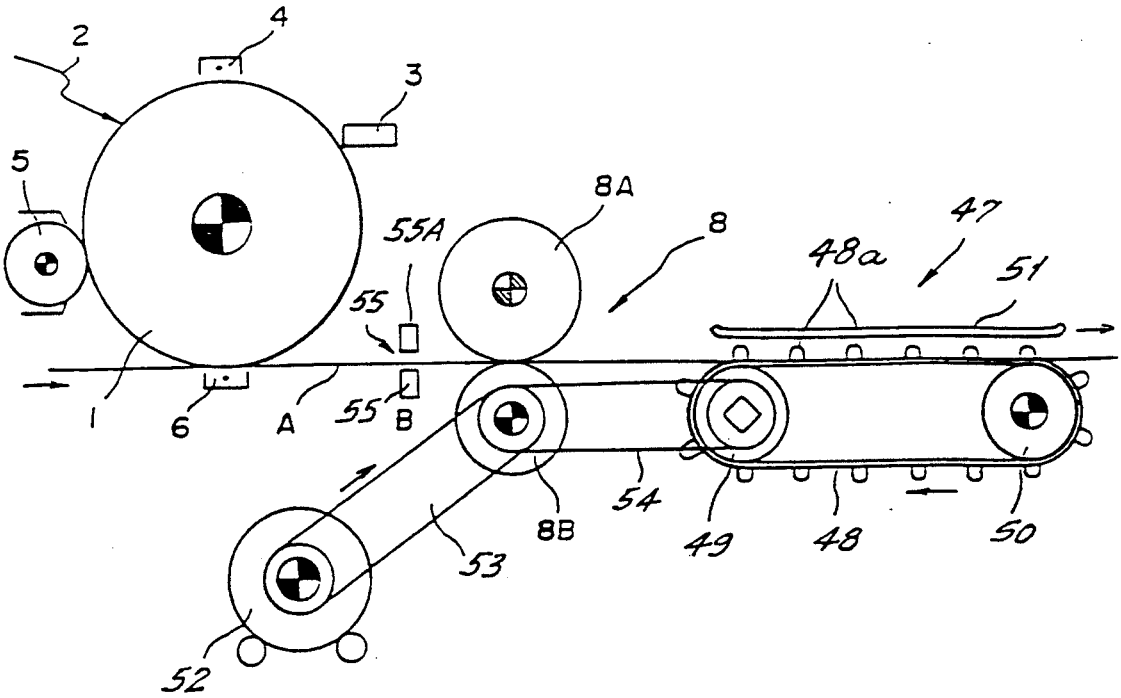

Embodiments based on these concepts will now be explained with reference to FIGS. 9 to 11. The embodiment according to FIG. 9 differs from that of FIG. 8 in that it is arranged so that the peripheral speed of the toner fixing section 8 and the label strip conveyance means 47 are made identical and that it has a label pitch sensor 55. The label pitch sensor 55 consists of a light emitting element 55 and a light receiving element **55*b* and is disposed on the conveyance path of the continuous label strip A. The light receiving element 55*b*** emits a high or low level signal depending on whether the portion of the continuous label strip A passing between the two elements consists solely of backing strip S or of backing strip S overlaid with a label L.

Figure 10:
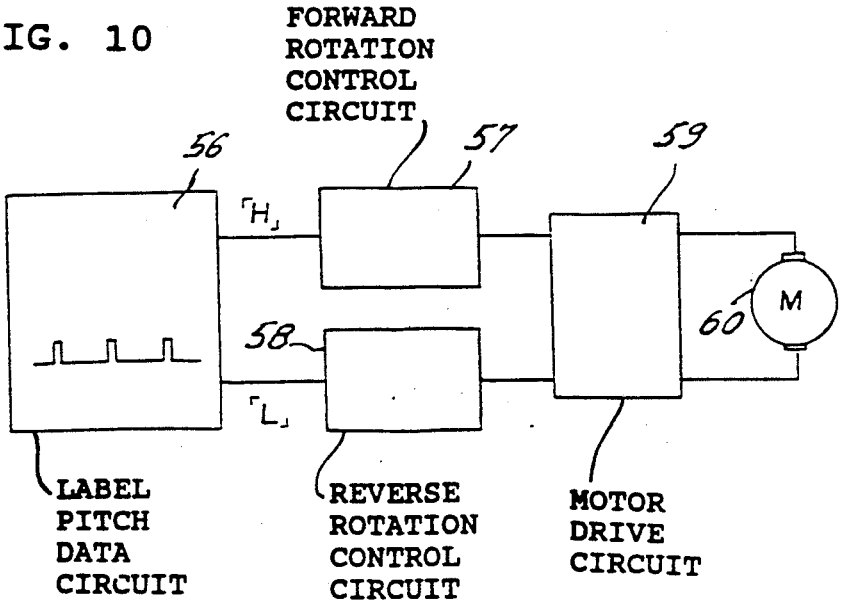
FIG. 10 is a block diagram of a controller for controlling a toner fixing section pressure switchover motor for reducing the contact pressure at the toner fixing section during passage of the regions of the continuous label strip consisting solely of backing strip.

A label pitch data circuit 56 configured as shown in FIG. 10 outputs a pressure switchover command signal to the circuit for controlling the contact pressure between the heat roller 8A and the auxiliary roller 8B, in the form of pulses delayed by a prescribed number of steps (i.e. steps of the motor 52) as determined on the basis of the conveyance speed of the continuous label strip A and the distance between the label pitch sensor 55 and the toner fixing section 8. Specifically, in response to the detection by the label pitch sensor 55 of a region D of the continuous label strip A consisting solely of backing strip S, the label pitch data circuit 56 outputs a high level signal "H" for reducing the contact pressure between the heat roller 8A and the auxiliary roller 8B, whereby a toner fixing section pressure switchover motor 60 is rotated in the forward direction through the operation of a forward rotation control circuit 57 and a motor drive circuit 59. On the other hand, when the label pitch sensor 55 detects a region of the continuous label strip A consisting of the backing strip S overlaid with a label L, the label pitch data circuit 56 outputs a low level signal "L" for restoring the contact pressure between the heat roller 8A and the auxiliary roller 8B from the decreased state to the normal state and, in response, the motor 60 is rotated in the reverse direction for a prescribed period of time through the operation of the reverse rotation control circuit 58 and the motor drive circuit 59.

Figure 11:
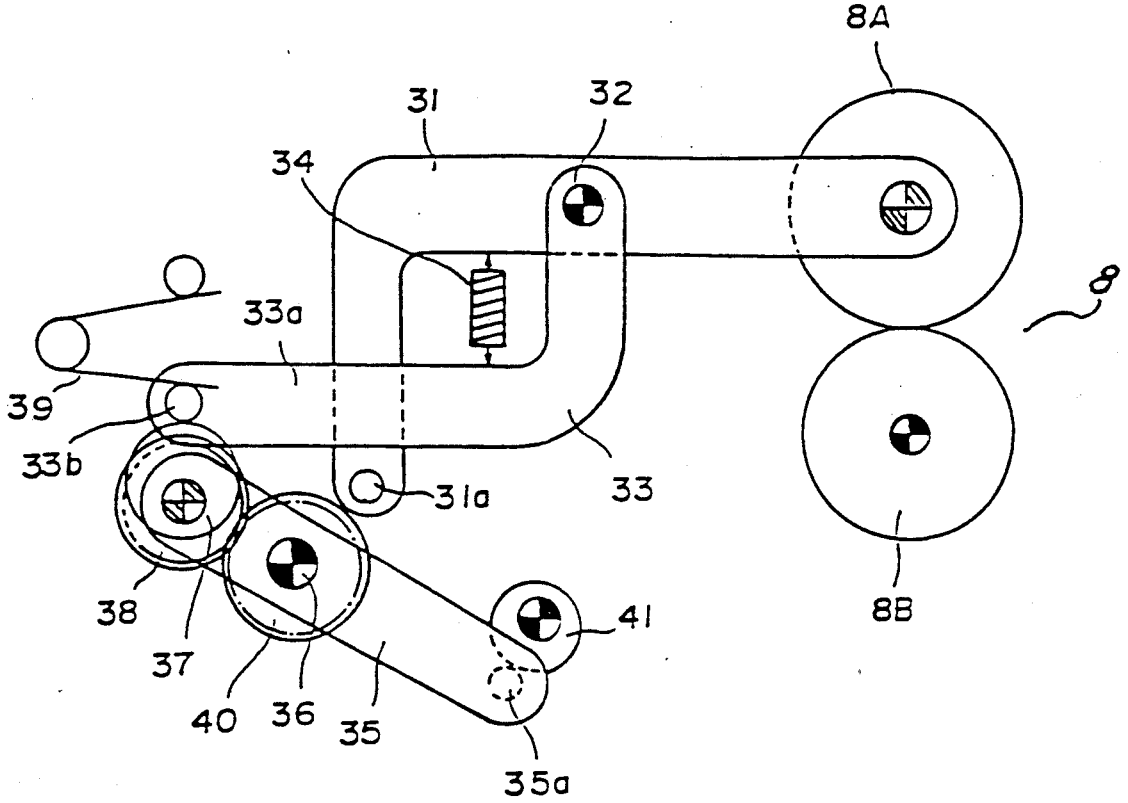
FIG. 11 is side view of a toner fixing section pressure control mechanism used in conjunction with the controller of FIG. 10.

The mechanism for switching over the contact pressure between the heat roller 8A and the auxiliary roller 8B is shown in FIG. 11. This mechanism resembles that shown in FIG. 5 but differs therefrom in that the high height portion of the cam 41 is normally in contact with the pin **35*a***.

In this embodiment, when the label pitch sensor 55 detects a region D of the continuous label strip A consisting solely of the backing strip S, the label pitch data circuit 56 responds by outputting a pressure switchover command signal "H," causing the forward rotation control circuit 57 and the motor drive circuit 59 to operate for rotating the toner fixing section pressure switchover motor 60 in the forward direction. The cam 41 is thus rotated to bring its low height surface in contact with the pin **35*a*. During this process, since the pin 35*a* follows the contour of the cam 41, causing the pressure regulation lever 35 to rotate counterclockwise, the gear 38 rolls along the gear 40, simultaneously rotating the cam 37 so as to allow the roller operating lever 33 to rotate counterclockwise under the force of the spring 39. Since the amount of force stored by the spring 34 is therefore reduced concurrently with the passage of a region D of the continuous label strip A consisting solely of the backing strip S through the toner fixing section 8, the contact pressure between the heat roller 8A and the auxiliary roller 8B** is also reduced at this time.

Thus, during the period that the contact pressure between the rollers 8A and 8B is reduced, the continuous label strip A is conveyed by the label strip conveyance means 47 at the same speed as the peripheral speed of the toner fixing section rollers.

In contrast, when the label pitch sensor 55 detects a portion of the continuous label strip A consisting of the backing strip S overlaid with a label L, the label pitch data circuit 56 responds by outputting a pressure switchover command signal "L," causing a reverse rotation control circuit 58 and the motor drive circuit 59 to operate for rotating the toner fixing section pressure switchover motor 60 in the reverse direction. The cam 41 is thus rotated to bring its high height surface in contact with the pin **35*a*. As the pressure regulation lever 35 therefore rotates clockwise, the gear 38 rolls along the gear 40 causing the cam 37 to rotate therewith. The cam 37 thus pushes the pin 33*b* upward causing the roller operating lever 33 to rotate clockwise against the force of the spring 39, whereby the amount of force stored by the spring 34 between the roller operating lever 33 and the roller support lever 3 is increased from its somewhat decreased state at that time. During the time that a label bearing portion of the continuous label strip A passes through the toner fixing section 8, therefore, the contact pressure between the heat roller 8A and the auxiliary roller 8B** is increased to the normal level required for proper fixing of the toner on the label L.

The foregoing operations are repeatedly conducted in response to the state of the continuous label strip A detected by the label pitch sensor 55, depending on whether the part of the continuous label strip A passing through the toner fixing section 8 is a region D consisting solely of backing strip S or a region consisting of the backing strip S overlaid with a label L.

If necessary, electrical or mechanical limit switches can be installed for ensuring proper alignment of the high and low height portions of the cam 41 with the pin **35*a***.

While the embodiments according to FIGS. 5 and 11 employ pin-tractor mechanisms as the label strip conveyance means, it is alternatively possible to use a sprocket type system.

As was explained earlier, the portion of the continuous label strip A remaining between the photosensitive drum 1 and the toner fixing section 8 after all of the printed labels have been output remains unprinted and is ordinarily discarded as an unusable segment. The discarding of this segment is particularly uneconomical since such a segment arises with every printing operation, making it important to reduce the amount of waste as much as possible.

Figure 12:
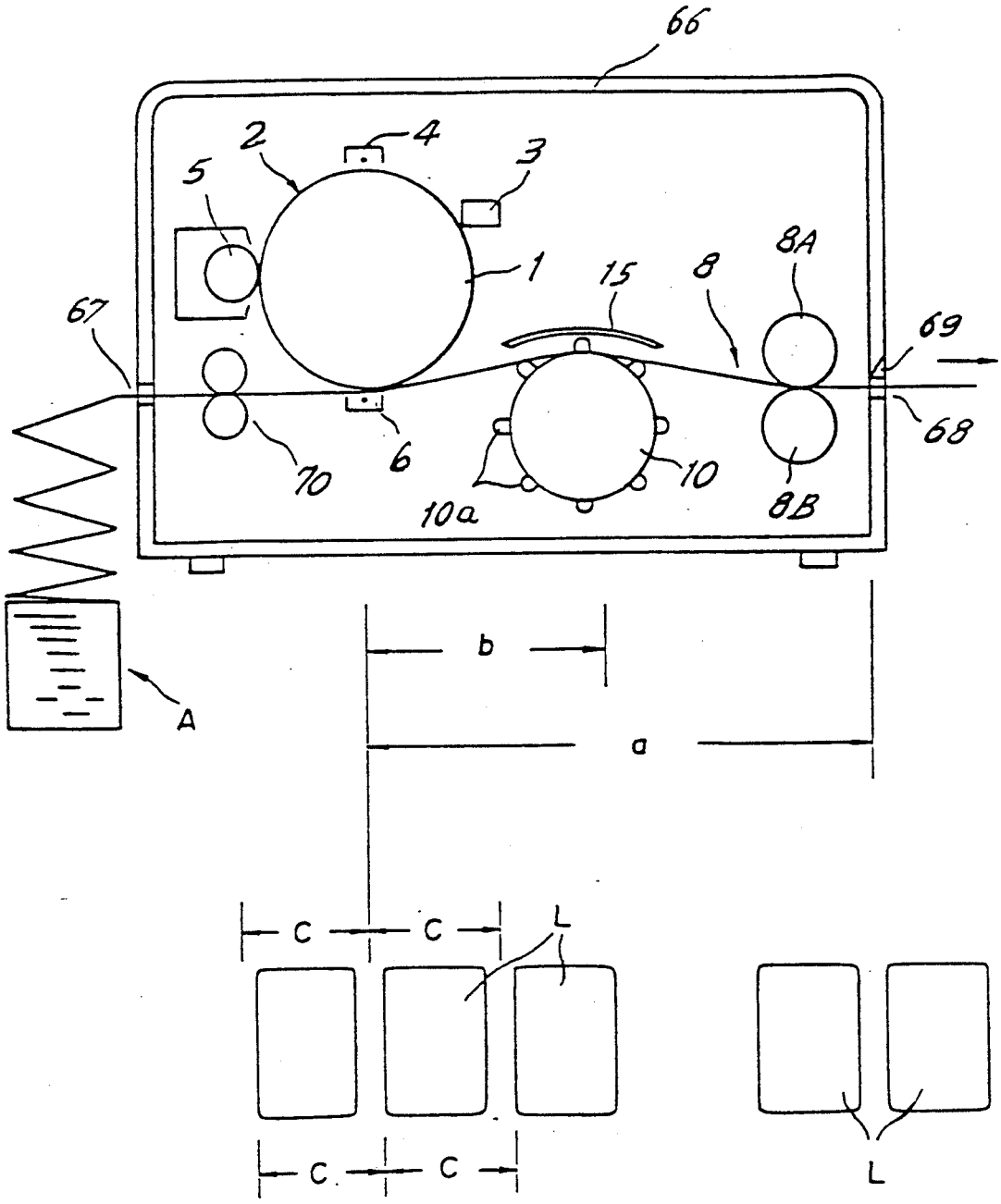
FIG. 12 is a schematic view of a xerographic apparatus in which the continuous label strip is conveyed in the reverse direction by a prescribed amount after cut-off of the printed labels.
Figure 13:
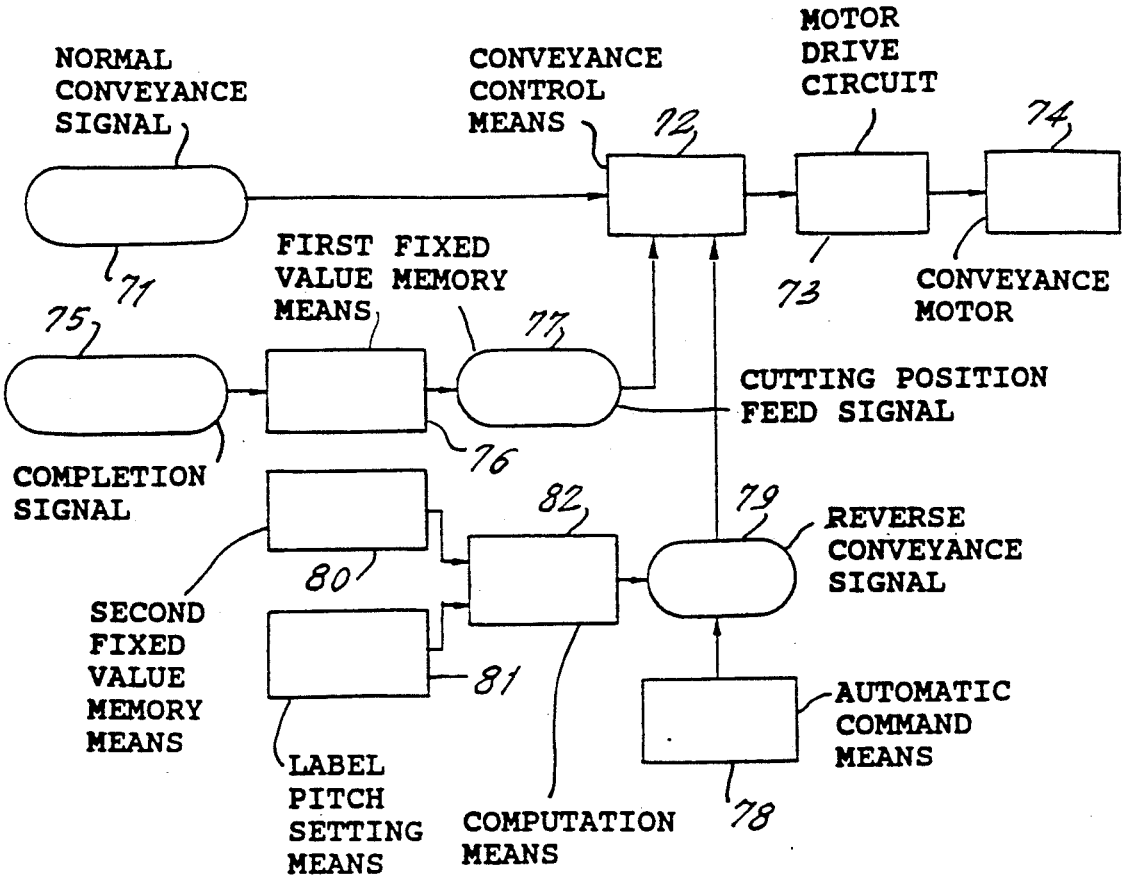
FIG. 13 is a block diagram of a controller for controlling forward and reverse conveyance of the continuous label strip.

An embodiment of a xerographic apparatus designed to minimize the amount of the continuous label strip A that goes to waste is shown in FIGS. 12 and 13.

As shown in FIG. 12, this embodiment has a housing 66 provided with an inlet 67 and an outlet 68 for the continuous label strip A. A cutter 69 for cutting the continuous label strip A is installed at the outlet 68. Reference numeral 70 designates a pair of conveyance rollers.

The distance between the photosensitive drum and the cutter 69 is indicated as a. This distance is equal to an integral multiple (m) of the label pitch c (the interval between adjacent ones of the labels cut from a label sheet and provisionally attached to the backing strip S of the continuous label strip A). Since the label pitch c varies with the type (length) of the labels L, the distance a is set at a value equal to a common multiple of the label pitches c of the different types of label strips intended for use.

The distance between the photosensitive drum 1 and the sprocket 10 is indicated as b.

In the arrangement according to FIG. 12, the continuous label strip A is conveyed from the inlet 67 of the housing 66 by the rollers 70 and the toner images are transferred to the individual labels L from the photosensitive drum 1 at the image transfer charger 6, whereafter the label strip is conveyed by the sprocket 10 to the toner fixing section 8 for fixing the toner images and is then discharged through the outlet 68.

As shown in FIG. 13, during normal printing and toner fixing operation, a normal conveyance signal 7 is applied to a conveyance control means 72 for causing a motor drive circuit 73 and a conveyance motor 74 to drive the sprocket 10 for conveying the continuous label strip A in the forward direction.

While the discussion here focuses mainly on the label strip conveyance, it will be understood that the operations of the photosensitive drum 1, the sprocket 10 and the toner fixing section 8 can be interrelated so as to obtain identical peripheral speeds at these sections.

After completion of image transfer of the final printing data to the labels L, a completion signal 75 is sent to a first fixed value memory means 76 which stores the aforesaid distance a and in response a cutting position feed signal 77 is produced and applied through the conveyance control means 72 and the motor drive circuit 73 to cause the conveyance motor 74 to drive the sprocket 10 in the forward direction until the last label L to which the printing data was transferred (which is positioned immediately downstream of the photosensitive drum 1) is advanced through the toner fixing section 8 to a discharge position immediately downstream of the cutter 69.

At this time an unprinted label is position immediately upstream of the cutter 69 and the last printed label is positioned immediately downstream thereof and the continuous label strip A can be cut between these two labels by lifting the portion thereof extending outward from the outlet 68 obliquely upward into contact with the cutter 69.

The pressure received by the cutter 69 during this cutting operation is detected and converted to a signal which is sent to an automatic command means 78 which, after a prescribed delay, causes a computation means 82 to produce a reverse conveyance signal 79.

Specifically, the computation means 82 computes the reverse conveyance signal 79 on the basis of the distance b stored in a second fixed value memory means 80 and the label pitch c stored in a label pitch setting means 81 and this signal is forwarded through the conveyance control means 72 and the motor drive circuit 73 to cause the motor 74 to drive the sprocket 10 in the reverse direction for drawing back the continuous label strip A by an amount for establishing the relationship $$c \times n > b > c \times (n-1)$$

where D is an integer smaller than m and m is the number of labels present between the photosensitive drum 1 and the cutter 69, specifically by an amount $c \times (m-n)$.

As a result, the continuous label strip A is returned to a position where the leading end of the unprinted section thereof (the sprocket holes P) still remains engaged with the sprocket 10 (pins 10*a*) and the leading end of one of the unprinted labels is located opposite the photosensitive drum 1.

During this reverse conveyance of the continuous label strip A, it is preferable for the image transfer charger 6 to be separated from the photosensitive drum 1 and for the heat roller 8A to be separated from the auxiliary roller 8B.

While it was stated that the reverse conveyance signal is produced automatically by the cutter, it is alternatively possible to produce it manually.

When the continuous label strip A is reversely conveyed in the foregoing manner, the amount of the continuous label strip A wasted as being unprintable is reduced accordingly.

The continuous label strip A is fabricated by provisionally adhering trimmed labels coated on the rear surface with adhesive at prescribed intervals to a backing strip S whose front surface is coated with a release agent. When the continuous label strip A passes through the toner fixing section 8, it is subjected to heat and pressure by the heat roller 8A and the auxiliary roller 8B.

While this operation is intended for fixing toner on the labels, the heat and pressure received by the labels L causes the adhesive coating on the rear side of the labels L to ooze out onto the portion of the continuous label strip A consisting solely of the backing strip S. Some of this adhesive sticks to the heat roller 8A.

Figure 14:
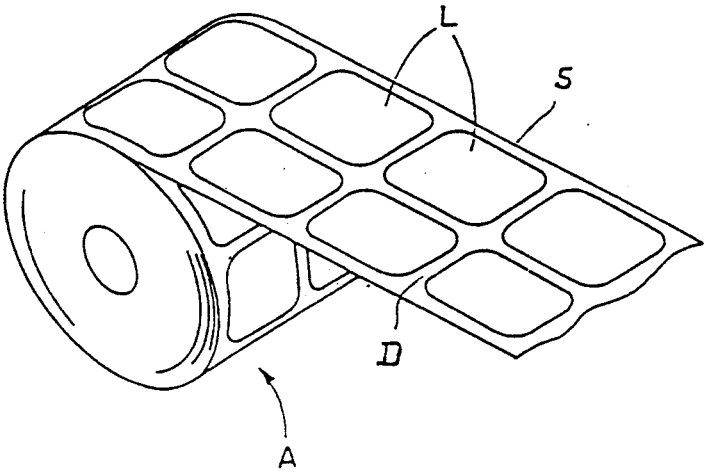
FIG. 14 is a perspective view of a roll type continuous label strip.

Moreover, in the case of a roll type continuous label strip A of the type shown in FIG. 14, the adhesive sometimes oozes out while the strip is still in the rolled up state, in which case the adhesive sticks to the overlying back surface of the backing strip S and may then transfer to the auxiliary roller 8B during use.

Such adhesion of the adhesive to the toner fixing section rollers may prevent the continuous label strip A from being discharged normally, in which case it is apt to wrap about one or the other of the toner fixing section rollers and cause jamming or other such problems. In addition, the adhesive doesn't stick evenly to all parts of the rollers so that the roller surfaces become irregular, which is likely to lead to uneven fixing of the toner.

Figure 15:
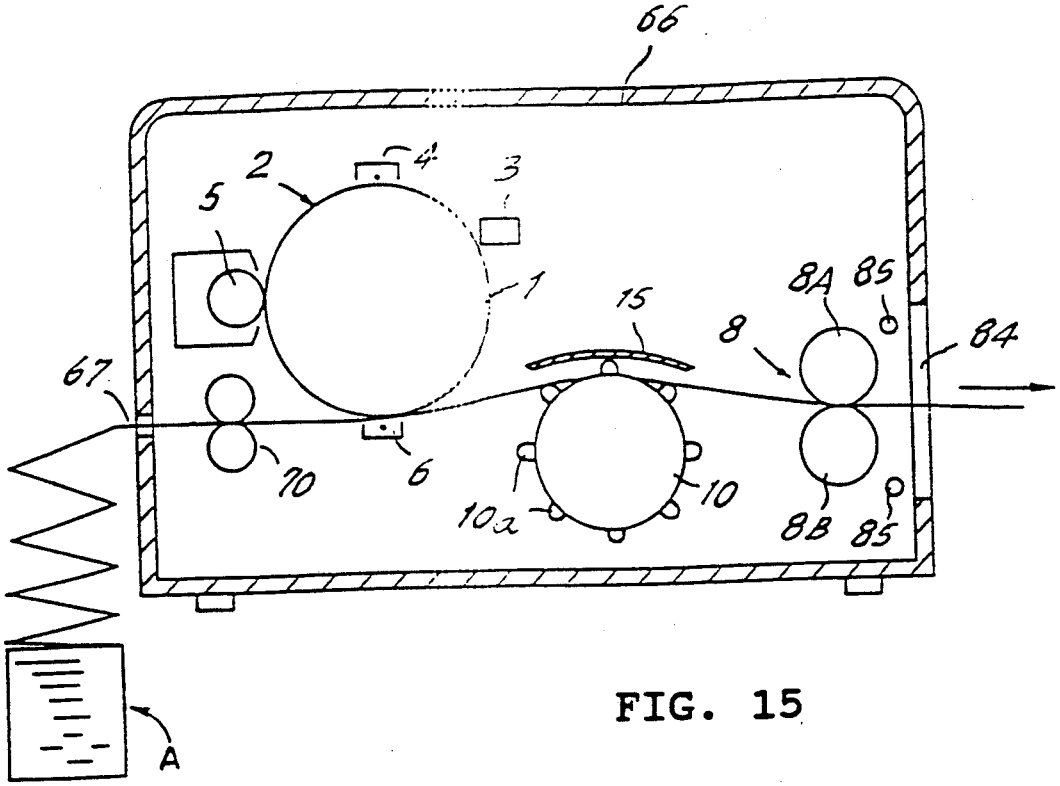
FIG. 15 is schematic view of a xerographic apparatus capable of being installed with a cleaner at the toner fixing section.
Figure 16:
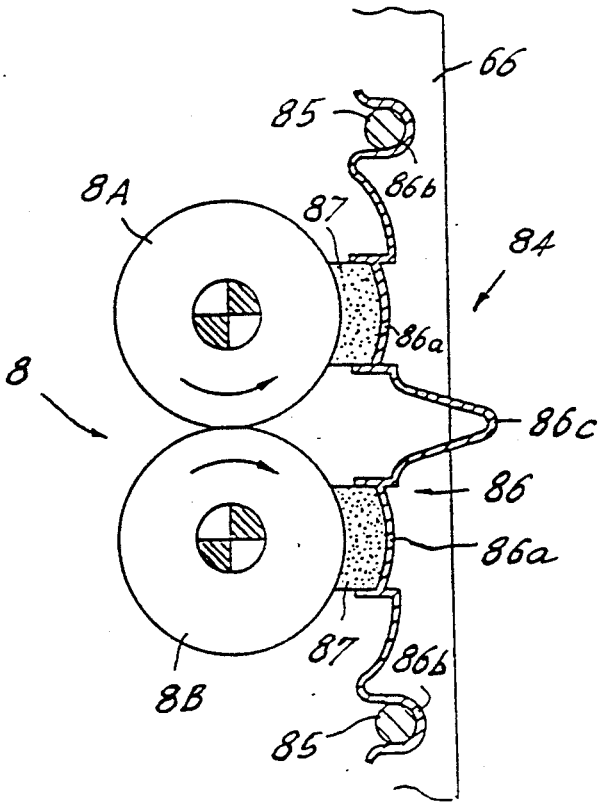
FIG. 16 is an enlarged view of the cleaner of FIG. 15.
Figure 17:
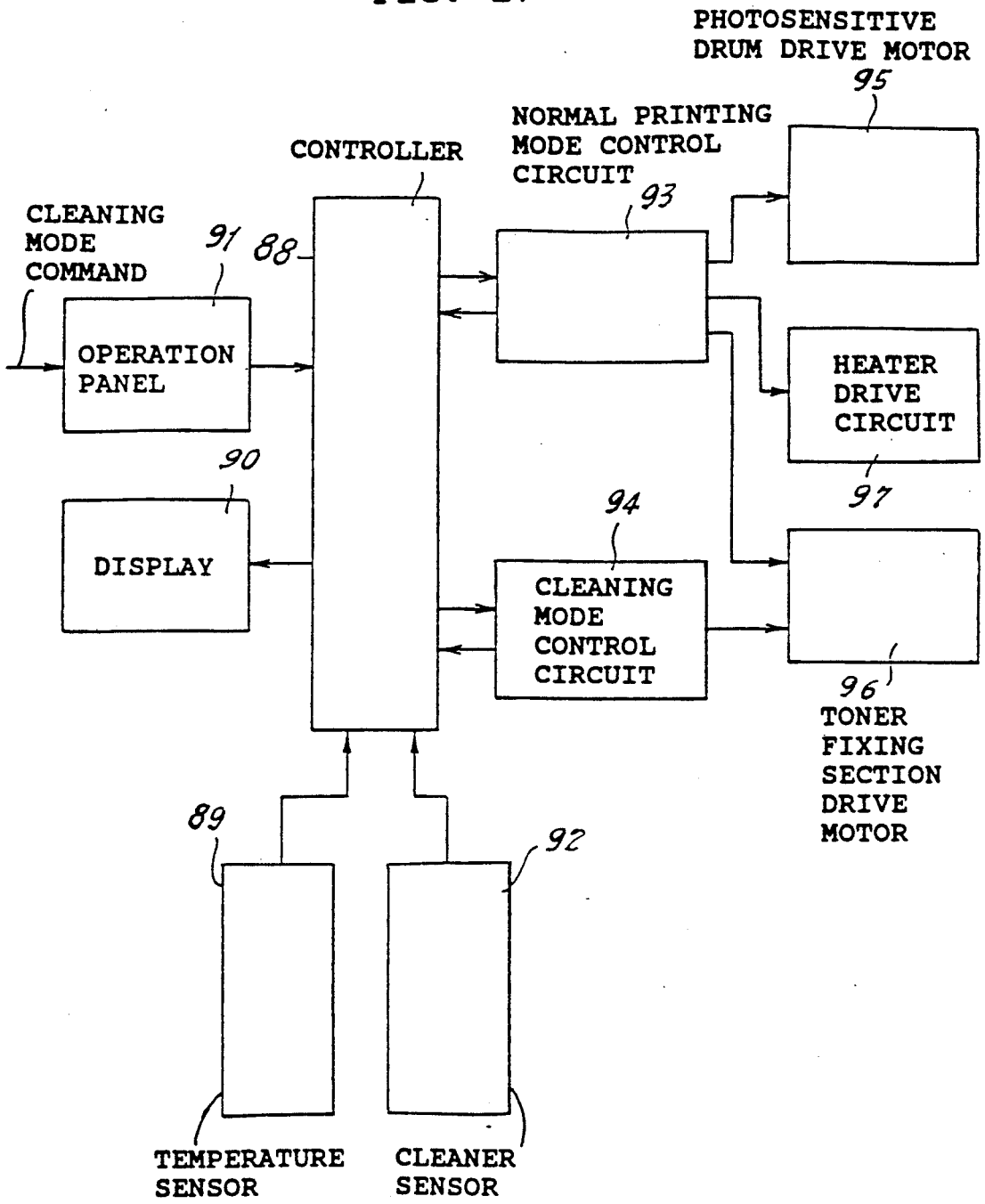
FIG. 17 is a block diagram of a controller used mainly for controlling the toner fixing section.

FIGS. 15–17 show an embodiment in which the foregoing problems are overcome by equipping the toner fixing section 8 of the xerographic apparatus with a mechanism for cleaning the rollers 8A and 8B.

Referring to FIG. 15, the housing 66 of the xerographic apparatus is provided with an outlet 84 having a larger opening than the outlet 68 of the apparatus shown in FIG. 12. In addition, a pair of pins 85 are provided between the toner fixing section 8 and the outlet 84 for detachably mounting a cleaner 86 described below.

As shown in FIG. 16, the cleaner 86 comprises support members 86*a*, 86*a* for supporting felt pads 87, 87 in contact with the heat roller 8A and the auxiliary roller 8B, hook members 86*b*, 86*b* which can be freely hooked on and released from the pins 85, 85, and a pinch-grip 86*c*. The pinch-grip 86*c* is formed as a spring-like member which opens vertically when the cleaner 86 is removed from the pins 85, 85.

When it is found during the operation of the xerographic apparatus that the toner fixing operation is likely to be adversely affected because the heat and pressure used for toner fixing has caused adhesive coated on the rear surfaces of the labels L to run onto the portion of the label strip consisting solely of the backing strip S and be picked up by the heat roller 8A and/or the auxiliary roller 8B, it becomes necessary to clean the toner fixing section 8.

In this case, the apparatus is stopped and the cleaner 86 is mounted therein as shown in FIG. 16. For this, the cleaner 86 is grasped by the pinch-grip 86*c* which is compressed with the fingers while the hook members 86*b*, 86*b* are brought toward and hooked on the pins 85, 85. Once engagement with the pins 85, 85 has been achieved, the pinch-grip 86*c* is released, whereby the cleaner 86 is retained resiliently between the pins 85, 85, with the felt pads 87, 87 in elastic contact with the heat roller 8A and auxiliary roller 8B.

The continuous label strip A is separated from the toner fixing section 8 when the apparatus is stopped and it can be presumed that in the final step of the preceding printing operation the backing strip was cut between a printed label and an unprinted label, whereafter the continuous label strip A was conveyed in the reverse direction within the range that this is possible without the strip coming off the sprocket 10.

The felt pads 87, 87 of the cleaner 86 are impregnated with normal hexane, ethyl acetate, alcohol or other such solvent.

Then when the power switch of the apparatus is turned on and the toner fixing section 8 is put in the cleaning mode, the heat roller 8A is independently rotated in a non-heated state by a separate drive source. As a result, the heat roller 8A and the auxiliary roller 8B rotatingly slide over the felt pads 87, 87 and the adhesive attached to the surfaces thereof is wiped off.

It is possible to establish a fixed period for the cleaning operation or, alternatively, to allow it to continue until the cleaning mode is discontinued.

In view of the use of one of the aforementioned solvents as a cleaning agent, it is important for the toner fixing section 8 (the heat roller 8A) to be in a non-heated state during the cleaning operation.

When the apparatus is turned on in the normal operating mode, the heat roller 8A is ordinarily heated for putting it into operating condition. When the cleaner 86 is installed, however, this is detected by a sensor or the like and the ordinary operating mode of the apparatus is disabled. Thus the apparatus is able to assume the normal operating mode only after the cleaner 86 has been removed. On the other hand, the toner fixing section 8 cannot be put in the cleaning mode when the cleaner 86 is not installed.

Since it is also dangerous to initiate the cleaning mode shortly after the completion of a printing operation due to the hot state of the roller 8A at that time, it is preferable to provide the apparatus with a display means which receives information from a temperature sensor or a timer and indicates whether or not installation of the cleaner 86 is possible.

FIG. 17 shows an embodiment having such a display, in which the element of the control system providing the information regarding the possibility of installing the cleaner 86 is a temperature sensor.

When the power switch of the apparatus is on, information is first displayed as to whether or not the temperature of the toner fixing section 8 (the heat roller 8A) has fallen low enough to permit installation of the cleaner 86. More specifically, a controller 88 displays the pertinent information on a display 90 based on the information it receives from a temperature sensor 89. For example, if installation is not permissible the message "Please wait" might be displayed and if it is, the message "Ready" might be displayed.

On the one hand, if no cleaning mode command is input from an operation panel 91 within a prescribed time after the power switch is turned on, the apparatus automatically enters normal printing mode provided that the information from a cleaner sensor 92 indicates that the cleaner is not installed.

On the other hand, if a cleaning mode command is input from the operation panel 91 within the prescribed time period following power-on, entry into the normal printing mode is prohibited.

If the cleaner 86 is inserted in response to the "Ready" message appearing on the display 90, the cleaning mode is established on the basis of "installation completed" information received from the cleaner sensor 92 and a cleaning mode control circuit 94 activates a toner fixing section drive motor 96 thus rotating the rollers of the toner fixing section 8. At this time a heater drive circuit 97 is not operated so that the heat roller 8A is not heated.

When the cleaner 86 is removed after completion of the cleaning operation, the operation mode is switched from cleaning to normal printing on the basis of "cleaner not installed" information from the cleaner sensor 92. As a result, a normal printing mode control circuit 93 first activates the heater drive circuit 97 and then either starts up a photosensitive drum drive motor 95 and the toner fixing section drive motor 96 or puts them in a standby state.

While this embodiment was described with respect to a case in which the heat roller 8A and the auxiliary roller 8B are cleaned in a pressure contacted state, the concept of this embodiment can also be applied to an apparatus in which these rollers are separated from each other upon completion of the printing operation. In this case, it is only necessary to modify the cleaner structure to match the positions of the rollers in the separated state and to provide means for driving the two rollers in the separated state.

When the xerographic apparatus is not in operation, the image transfer charger 6 is moved to a retracted position away from the photosensitive drum 1 and when the apparatus is in operation, it is returned to its image transfer operating position near the photosensitive drum 1.

Changing of the continuous label strip A is sometimes conducted when the apparatus is in the non-operating state.

The operation of changing the continuous label strip A involves removing the unprinted length of the continuous label strip A remaining inside the apparatus and loading a fresh continuous label strip A into the apparatus.

At the time of removing and loading continuous label strip A from and into the apparatus, it is necessary to avoid contact of the continuous label strip A with the photosensitive drum 1. A paper depressor is therefore provided to operate conjointly with the operation for moving the image transfer charger 6 to a position retracted from the photosensitive drum 1, in such manner that the continuous label strip A in contact with the photosensitive drum 1 is drawn away from it at the same time that the image transfer charger 6 is retracted.

This paper depressor also controls the conveyance path of the continuous label strip A at the time it is loaded into the apparatus so as to prevent it from coming in contact with the photosensitive drum 1.

When the image transfer charger 6 is returned to the image transfer position, the paper depressor is simultaneously moved to a position where it will not interfere with the conveyance of the continuous label strip A.

As was explained earlier, in a continuous label strip A consisting of trimmed labels provisionally attached to a backing strip S, the adhesive applied to the labels L sometimes oozes onto the part of the strip consisting solely of the backing strip S.

When the continuous label strip A is changed with the apparatus in a non-operating state, the old continuous label strip A rubs over the paper depressor as it is being drawn out and the new continuous label strip A is loaded into the apparatus with its conveyance path controlled by the paper depressor.

As a result of this contact between the continuous label strip A and the paper depressor, adhesive is likely to stick to the paper depressor.

When a continuous label strip A is loaded into an apparatus whose paper depressor is fouled with adhesive, the label strip does not pass smoothly past the paper depressor region and may have one or more of its labels L peeled off by contact with the adhesive. This becomes a particular problem if a peeled off label L should adhere to the photosensitive drum 1.

A major cause for the adherence of adhesive to the conventional paper depressor is that the paper depressor is formed as a simple cylindrical roller which makes linear contact with the continuous label strip A over its full width.

Figure 18:
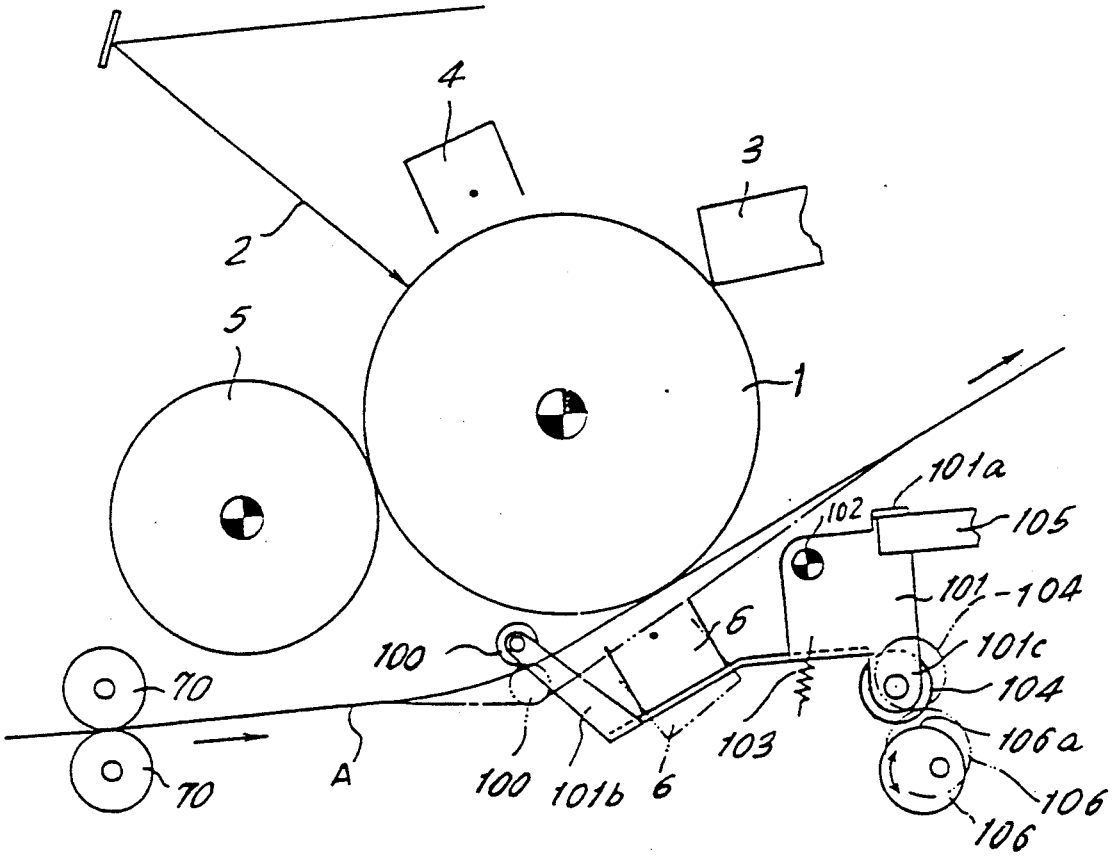
FIG. 18 is a side view for explaining movement of an image transfer charger toward and away from a photosensitive drum and displacement of a paper depressor for separating the continuous label strip from the photosensitive drum.

FIG. 18 shows how the actions of the image transfer charger 6 and a paper depressor 100 are coordinated in accordance with the invention through their installation on a common support plate 101.

Specifically, the support plate 101 is pivotally mounted on a shaft 102 and is biased clockwise by a spring 103. The support plate 101 is further formed with a bent portion 101*a* and arms 101*b*, 101*c*.

The support plate 101 is formed to support the image transfer charger 6 over its full length, which corresponds to the width of the photosensitive drum 1, while an arm 101*b* is provided at either side of the support plate 101.

Between the pair of arms 101*b* a paper depressor 100 is supported comprising a rotating body capable of moving in coordination with the image transfer charger 6 between a first position indicated in solid lines in the figure at which it is not in contact with the continuous label strip A and allows the continuous label strip A to make contact with the photosensitive drum 1 and a second position indicated in two-dot chain lines at which it is in contact with the continuous label strip A (on the label side) and retains the continuous label strip A apart from the photosensitive drum 1.

A cam follower 104 is pivotally supported on the arm 101*c*.

The most clockwise position of the support plate 101, i.e. its position when the image transfer charger 6 is in its image transfer position, is determined by a stop 105 opposed to the bent portion 101*a*.

An operation/non-operation switchover cam member 106 capable of rotating in the directions indicated by the arrows is provided with its cam surface 106*a* facing the cam follower 104.

Figure 19:
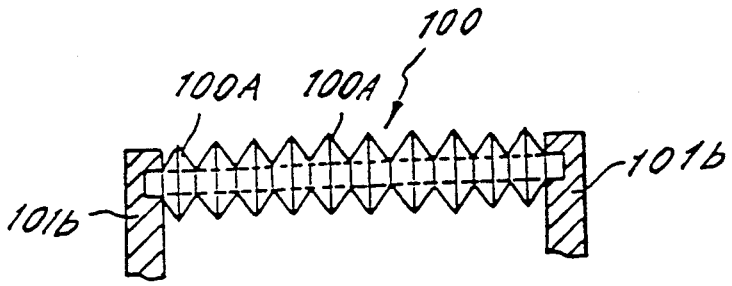
FIGS. 19, 20 and 21 are illustrations showing specific examples of the paper depressor.

In the present embodiment, the paper depressor 100 is a rotating body comprising a row of rollers of diamond-shaped section, as shown in FIG. 19.

Figure 20:
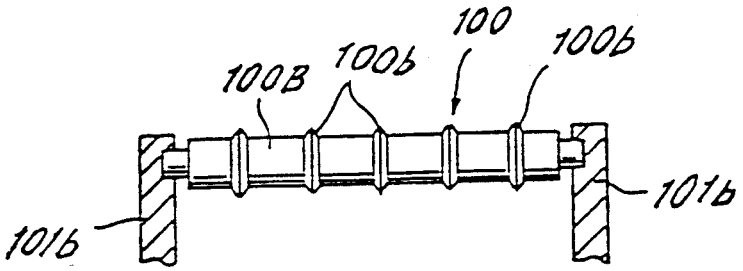

Alternatively, the paper depressor 100 can be a rotating body comprising a cylindrical rod 100B having a plurality of pointed rings formed at prescribed intervals thereon, as shown in FIG. 20, or of a cylindrical rod 100C replacing the arms 101*b* and having a wire 100*c* wound helically thereon.

Figure 21:
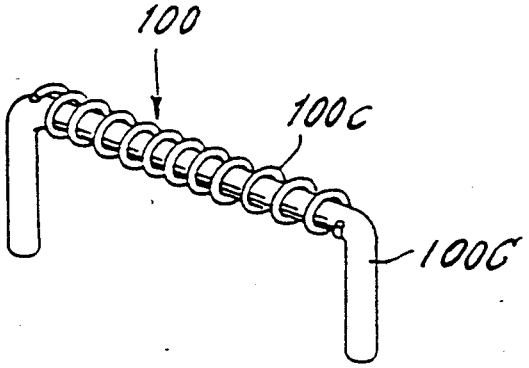

It was found that when a paper depressor 100 of the configuration shown in FIG. 19, 20 or 21 was used, the amount of adhesive adhering to the paper depressor 100 decreased and labels were not peeled off the backing strip S during the loading of a new continuous label strip A into the apparatus.

The reason for the decrease in the amount of adhesive that sticks to the paper depressor 100 is presumed to be that when a paper depressor 100 according to the invention is used, the contact with the continuous label strip A occurs only at discrete points across the width of the strip.

Figure 22:
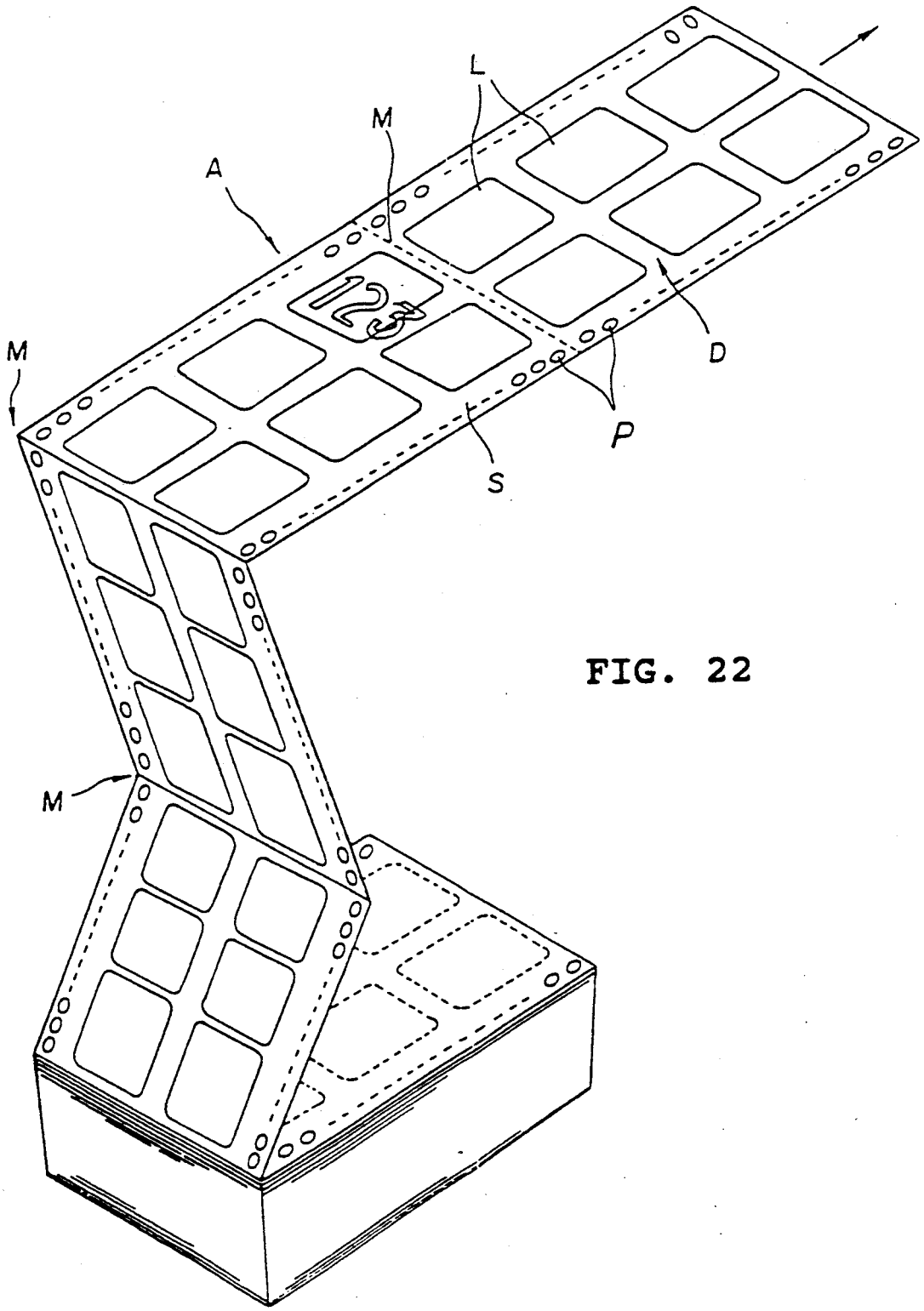
FIG. 22 a perspective view for explaining a case in which the printing extends beyond the label region onto the region of the continuous label strip consisting solely of backing strip.

Another problem with conventional xerographic apparatus which use a continuous label strip fabricated by provisionally attaching trimmed labels at intervals on a backing strip will be understood from FIG. 22.

As can be seen in this figure, when printing data extending over a region larger than the size of a single label L is input, and also when a deviation occurs between the label position and the printing position, a part of the printed data is printed on the backing strip S and not on the label. For example, as illustrated, where "123" is printed, a part of the printing runs beyond the edge of the label.

The backing strip S is coated with a release agent such as silicon oil so as to make it easy to peel the labels off the backing strip S. The toner adhering to the exposed areas of the backing strip S is thus easily removed therefrom.

As a result, when a toner image formed by adherence of toner to a latent image is transferred to the surface of the continuous label strip A and the continuous label strip A is then sent to the toner fixing section 8, the toner at the aforesaid regions sticks to the heat roller 8A.

The toner transferred to the heat roller 8A in this way is likely to be transferred to a label in the next printing operation, at a portion thereof not intended to be printed. The printed information is therefore defiled.

Moreover, where a felt cleaner is used for cleaning the surface of the heat roller 8A, its service life is shortened.

Further, where a static electric erasing brush is provided downstream of the toner fixing section 8 for removing static electricity from the continuous label strip A, the rate at which it gets dirty increases markedly.

In addition, toner falling from the toner fixing section rollers and from the surface of the continuous label strip A contaminates the interior of the apparatus.

These problems can be overcome by comparing the label size (area) with the area of the printed data and eliminating any printing data which falls outside the label area before printing. As this ensures that no printing will be conducted on the exposed regions of the backing strip S, no toner will attach to these areas so that toner contamination of the toner fixing section 8 and the interior of the apparatus can be prevented.

Since the label is printed irrespective of the fact that a part of the printing information has been omitted, the operator will still be able to ascertain the problem by visually inspecting the printing.

Figure 23:
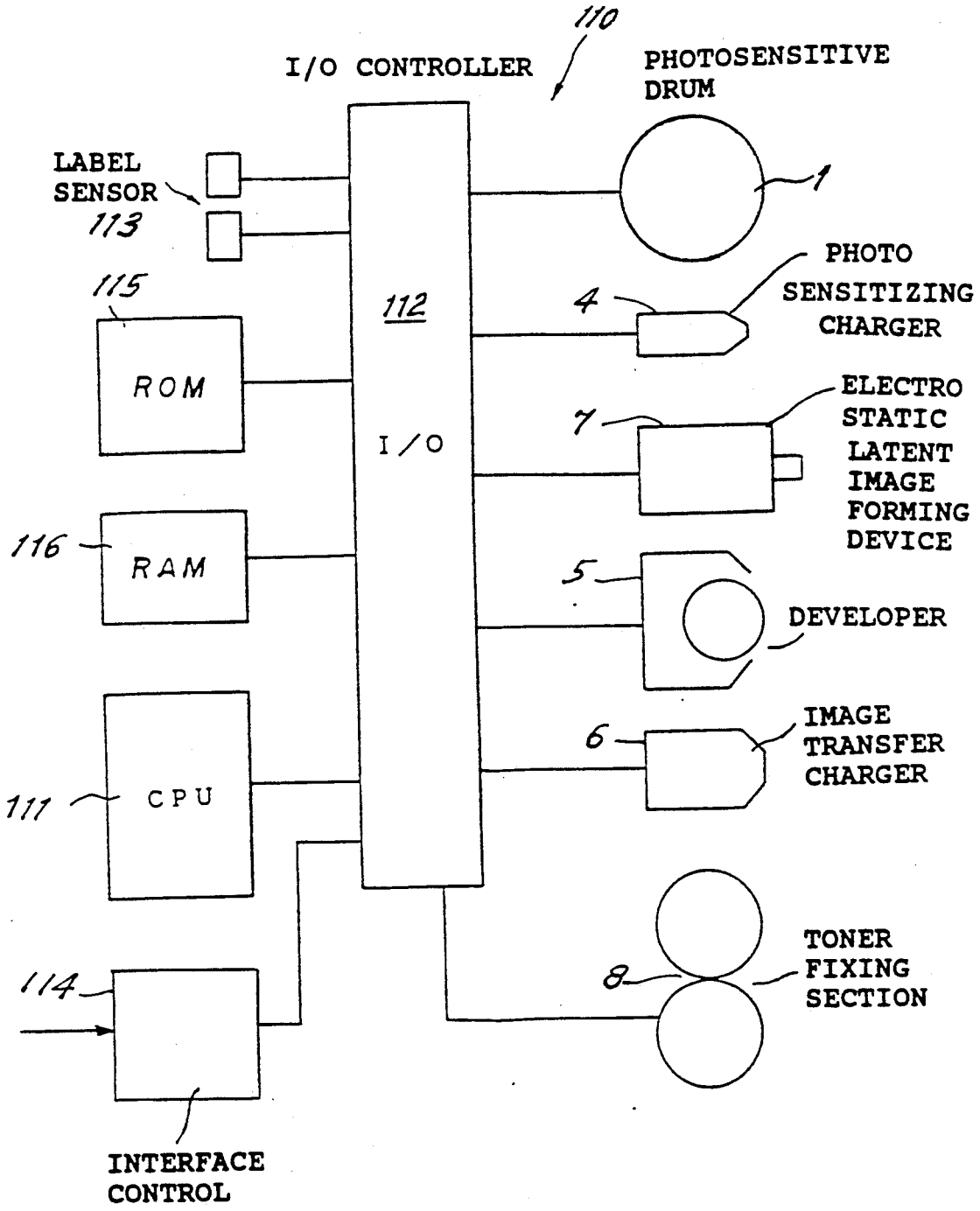
FIG. 23 is a block diagram of a xerographic apparatus control circuit.

FIG. 23 is a block diagram of a xerographic apparatus control circuit 110 for carrying out printing in the aforesaid manner. An I/O controller 112 controlled by a central processing unit (CPU) 111 is connected with the photosensitive drum 1, an electrostatic latent image forming device 7 which outputs the beam 2, the photosensitizing charger 4, the developer 5, the image transfer charger 6 and the toner fixing section 8. Reference numeral 113 designates a label sensor which is installed between the conveyance rollers 70 and the image transfer section and is also connected with the I/O controller 112. Also connected with the I/O controller 112 are an interface control means 114 for analyzing signals received from a keyboard or an external host control unit (neither shown), a program storage means ROM 115 and a data storage means (RAM) 116.

Figure 24:
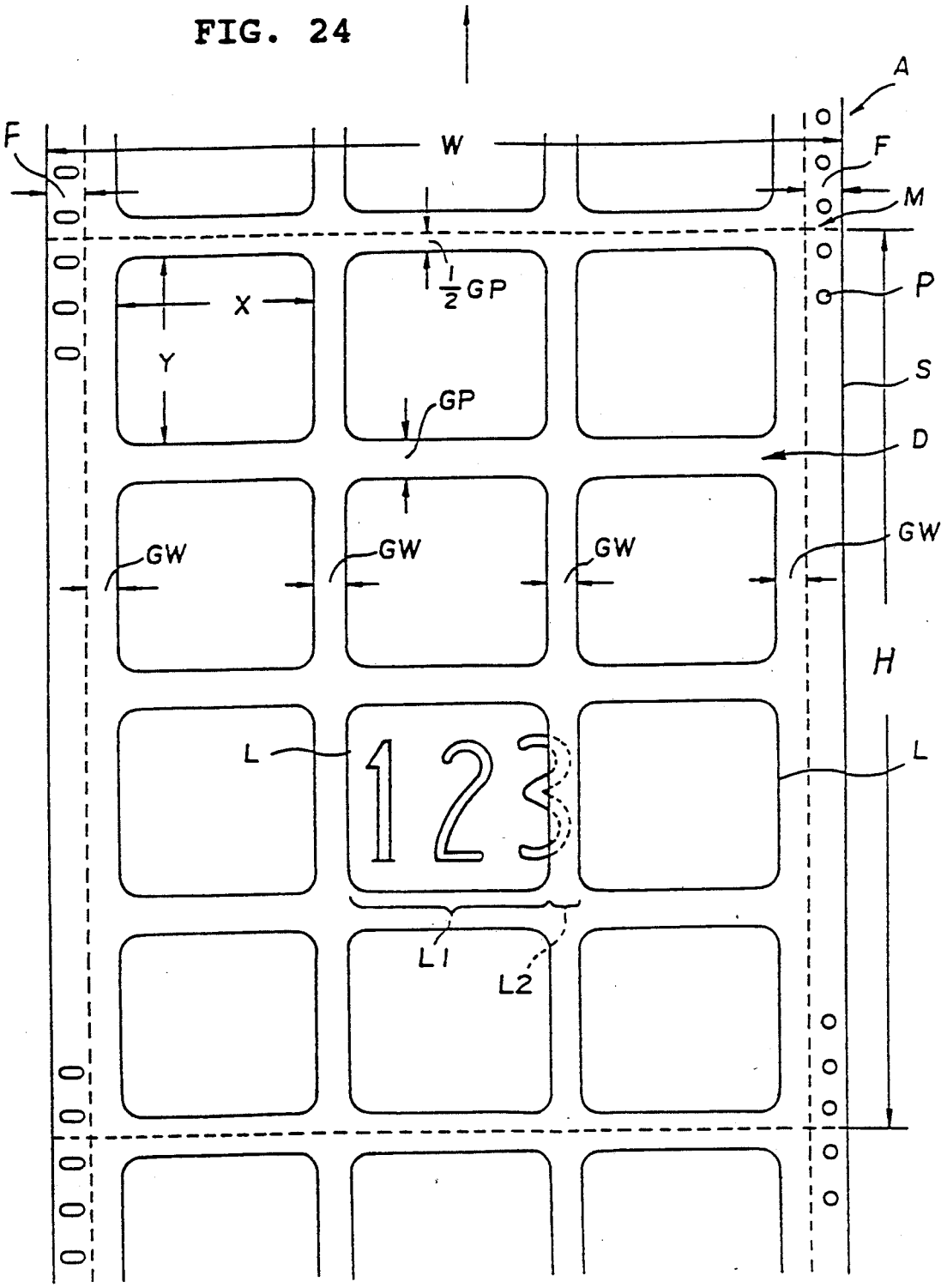
FIG. 24 is a plan view of a continuous label strip.

The interface control means 114 is capable of accepting input not only of printing data but also of size data such as indicated in FIG. 24.

Specifically, the data shown in FIG. 24 relating to the size of the continuous label strip A, the size of the labels L and the size of the gaps between the labels are also input. For example, the width W of the continuous label strip A is input in millimeters (hereinafter the same) in the form (d2d1d0) where d0 is the "1" place digit, d1 is the "10" place digit and d2 is the "100" place digit. The magnitudes of the dimensions P, F, X, Y, GW, GP etc. are similarly input. Further, the length (pitch) H of a single sheet is input as (h2h1h0) and the width F of the perforated sprocket hole strips is input as (f0).

The label width is input as (x1x0), the label length as (y1y0), the width GW of the gaps corresponding to the regions D to be detected as (gw0) and the pitch GP as (gp0). The pitch of the perforated sections M is presumed to be one half of GP.

Figure 25:
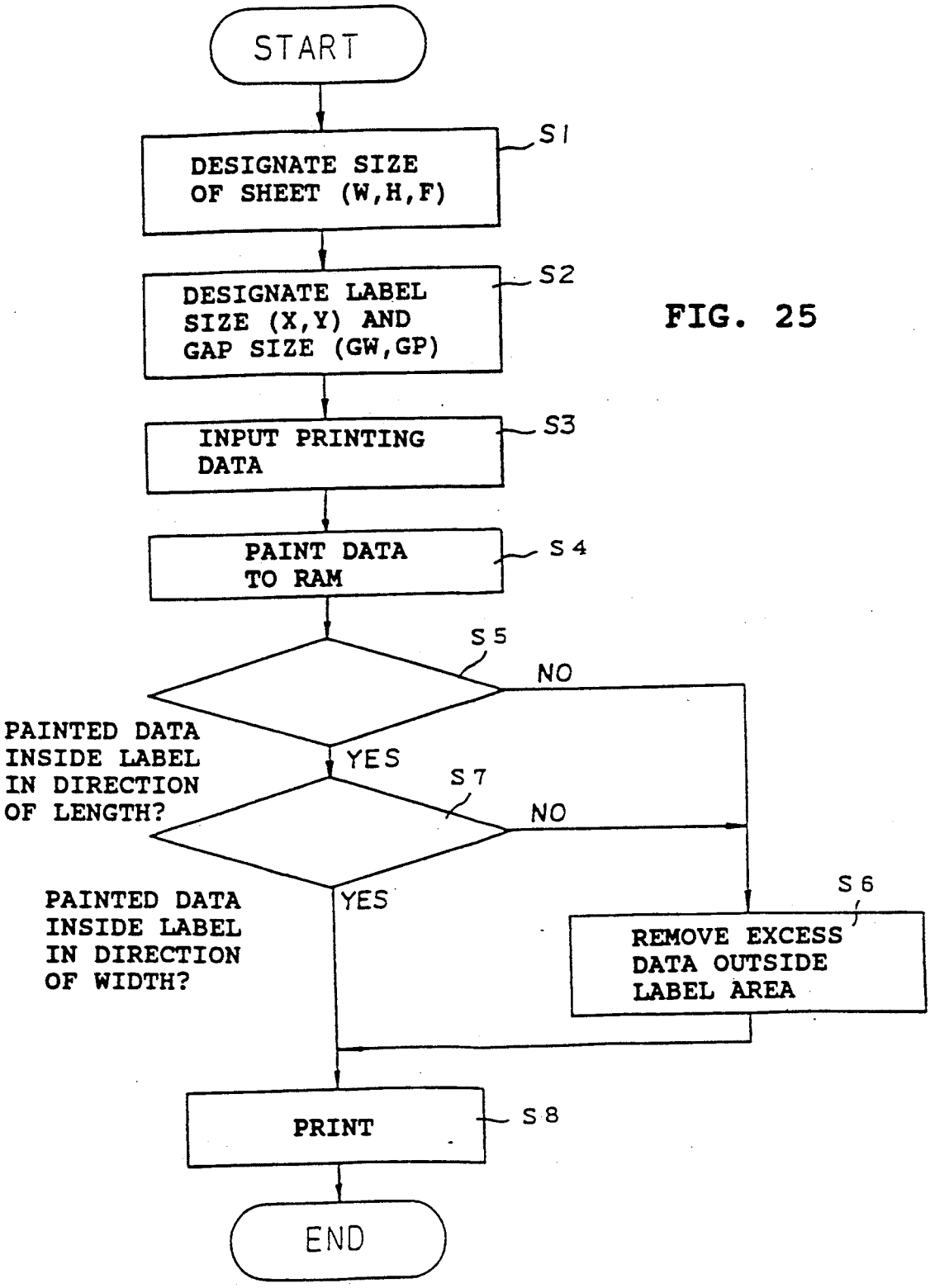
FIG. 25 is printing control flowchart.

The printing control of the xerographic apparatus will now be explained with reference to the flowchart of FIG. 25.

In step S1 the operator designates the size of the sheet (W, H, F) in the aforesaid manner. The procedure then advances to step S2 in which the label size (X, Y) and the gap sizes (GW, GP) are designated and then to step S3 in which the printing data is input.

In the following step the printing data is "painted" to the RAM 116. While the painted data is the same as the printing data, it will be referred to as painted data in this explanation.

The operation then advances to step S5 in which discrimination is made as to whether the painted data is inside or outside of the label in the direction of label width, and if any part of it is outside, this part of the painted data is removed in step S6. If the painted data is found to be within the limits of the label size in step S5, the procedure moves to step S7 in which discrimination is made as to whether the painted data is inside or outside of the label in the direction of label length, and if any part of it is outside, this part of the painted data is removed in step S6.

If the data is found to be within the limits of the label size in step S7, the procedure moves to step S8 in which actual printing is conducted.

Since it is discriminated whether the size of the printing data is within or extends beyond the size (area) of the label L and any part thereof extending beyond the limits of the label are removed before printing, adherence of toner to the regions of the continuous label strip A at which the backing strip S is exposed can be prevented.

For example, in the case where the printing data "123" shown in FIG. 24 is input, only the part falling within the first region L1 of the label L is printed and the part falling within the second region L2 (the part of the numeral 3 extending onto the backing strip S and indicated in the figure by a dotted line) is not printed.

The operator will notice from the first few labels printed in this manner that part of the information intended to be printed is missing because it extended beyond the edge of the label, and will then adjust the input data as required for proper printing.

Although the present invention has been described in relation to particular embodiments thereof, many other variations and modifications and other uses will become apparent to those skilled in the art. Therefore, the present invention is limited not by the specific disclosure herein, but only by the appended claims.

What is claimed is:

1. A xerographic apparatus for a label printer receiving a continuous label strip, the label strip having labels trimmed to appropriate shape and provisionally attached to a backing strip, the apparatus comprising:

a photosensitive drum rotatable at a prescribed peripheral speed;

toner fixing means;

label strip conveyance means positioned between the photosensitive drum and the toner fixing means for conveying the label strip at a speed equal to the peripheral speed of the photosensitive drum;

a motor for independently driving the toner fixing means;

slack detection means positioned between the label strip conveyance means and the toner fixing means for detecting slack in the label strip, said slack detection means comprising a light transmitter and a light receiver, the light transmitter transmitting light onto the label strip and the light receiver receiving light from the transmitter reflected off the label strip, the amount of light received by the receiver being related to the amount of slack in the label strip; and speed control means responsive to an output of the slack detection means for increasing the speed of the motor when the slack detection means detects slack in the label strip.

2. A xerographic apparatus for a label printer receiving a continuous label strip, the label strip having labels trimmed to appropriate shape and provisionally attached to a backing strip having sprocket holes along either edge thereof, the apparatus comprising:

a photosensitive drum rotatable at a prescribed peripheral speed;

toner fixing means;

label strip conveyance means positioned between the photosensitive drum and the toner fixing means for conveying the label strip by engagement with the sprocket holes at a speed equal to the peripheral speed of the photosensitive drum;

a motor for independently driving the toner fixing means;

slack detection means positioned between the label strip conveyance means and the toner fixing means for detecting slack in the label strip, said slack detection means comprising a light transmitter and a light receiver, the light transmitter transmitting light onto the label strip and the light receiver receiving light from the transmitter reflected off the label strip, the amount of light received by the receiver being related to the amount of slack in the label strip; and speed control means responsive to an output of the slack detection means for increasing the speed of the motor when the slack detection means detects slack in the label strip.

3. A xerographic apparatus for a label printer, receiving a continuous label strip, the label strip having labels trimmed to appropriate shape and provisionally attached to a backing strip having sprocket holes along either edge thereof, the apparatus comprising:

a photosensitive drum rotatable at a prescribed peripheral speed;

toner fixing means;

label strip conveyance means positioned between the photosensitive drum and the toner fixing means for conveying the label strip by engagement with the sprocket holes at a speed equal to the peripheral speed of the photosensitive drum;

a motor for independently driving the toner fixing means;

slack detection means positioned between the label strip conveyance means and the toner fixing means for detecting slack in the label strip; and speed control means responsive to an output of the slack detection means for increasing the speed of the motor when the slack detection means detects slack in the label strip and further wherein the label strip conveyance means is adjustable to the width of the label strip and the slack detection means is coupled with the label strip conveyance means.

4. A xerographic apparatus for a label printer receiving a continuous label strip having labels trimmed to appropriate shape and provisionally attached to a backing strip, the apparatus comprising:

a photosensitive rotatable drum;

toner fixing means;

label strip conveyance means positioned between the photosensitive drum and the toner fixing means for conveying the label strip;

pressure variation means for varying clamping force applied to the label strip for conveyance at the toner fixing means;

slack detection means positioned between the label strip conveyance means and the toner fixing means for detecting slack in the label strip; and pressure control means responsive to an output of the slack detection means for increasing the clamping force of the pressure variation means when the slack detection means detects slack in the label strip.

5. A xerographic apparatus for a label printer receiving a continuous label strip having labels trimmed to appropriate shape and provisionally attached to a backing strip having sprocket holes along either edge thereof, the apparatus comprising:

a photosensitive rotatable drum;

toner fixing means;

label strip conveyance means positioned between the photosensitive drum and the toner fixing means for conveying the label strip by engagement with the sprocket holes;

pressure variation means for varying clamping force applied to the label strip for conveyance at the toner fixing means;

slack detection means positioned between the label strip conveyance means and the toner fixing means for detecting slack in the label strip; and pressure control means responsive to an output of the slack detection means for increasing the clamping force of the pressure variation means when the slack detection means detects slack in the label strip.

6. A xerographic apparatus for a label printer according to claim 5, wherein the label strip conveyance means is adjustable to the width of the label strip and the slack detection means is coupled with the label strip conveyance means.

7. A xerographic apparatus for a label printer receiving a continuous label strip, the label strip having labels trimmed to appropriate shape and provisionally attached to a backing strip, the apparatus comprising:

a photosensitive drum rotatable at a prescribed peripheral speed;

toner fixing means;

label strip conveyance means positioned for conveying the label strip at a speed equal to the peripheral speed of the photosensitive drum;

a motor for independently driving the toner fixing means;

slack detection means positioned between the label strip conveyance means and the toner fixing means for detecting slack in the label strip, said slack detection means comprising a light transmitter and a light receiver, the light transmitter transmitting light onto the label strip and the light receiver receiving light from the transmitter reflected off the label strip, the amount of light received by the receiver being related to the amount of slack in the label strip,; and speed control means responsive to an output of the slack detection means for increasing the speed of the motor when the slack detection means detects slack in the label strip.

8. A xerographic apparatus for a label printer receiving a continuous label strip having labels trimmed to appropriate shape and provisionally attached to a backing strip, the apparatus comprising:

a photosensitive rotatable drum;

toner fixing means;

label strip conveyance means positioned for conveying the label strip;

pressure variation means for varying clamping force applied to the label strip for conveyance at the toner fixing means;

slack detection means positioned between the label strip conveyance means and the toner fixing means for detecting slack in the label strip; and pressure control means responsive to an output of the slack detection means for increasing the clamping force of the pressure variation means when the slack detection means detects slack in the label strip.

* * * * *